US010490883B2

(12) United States Patent
Tsai et al.

(10) Patent No.: US 10,490,883 B2
(45) Date of Patent: Nov. 26, 2019

(54) MOBILE DEVICE AND ANTENNA STRUCTURE

(71) Applicant: HTC Corporation, Taoyuan (TW)

(72) Inventors: Tiao-Hsing Tsai, Taoyuan (TW); Chien-Pin Chiu, Taoyuan (TW); Hsiao-Wei Wu, Taoyuan (TW); Chao-Chiang Kuo, Taoyuan (TW)

(73) Assignee: HTC CORPORATION, Taoyuan (TW)

( * ) Notice: Subject to any disclaimer, the term of this patent is extended or adjusted under 35 U.S.C. 154(b) by 0 days.

(21) Appl. No.: 15/599,247

(22) Filed: May 18, 2017

(65) Prior Publication Data

US 2017/0256845 A1 Sep. 7, 2017

Related U.S. Application Data

(63) Continuation of application No. 13/672,464, filed on Nov. 8, 2012, now Pat. No. 9,716,307.

(51) Int. Cl.
*H01Q 1/24* (2006.01)
*H01Q 13/10* (2006.01)

(52) U.S. Cl.
CPC ..... *H01Q 1/243* (2013.01); *H01Q 13/106* (2013.01)

(58) Field of Classification Search
CPC ..... H01Q 13/106; H01Q 1/24; H01Q 1/243; H01Q 1/38; H01Q 13/103; H01Q 13/18; H01Q 13/28; H01Q 5/22
See application file for complete search history.

(56) References Cited

U.S. PATENT DOCUMENTS 2,885,676 A * 5/1959 Baldwin ..... H01Q 13/18 343/767
6,400,571 B1 6/2002 Kimura et al.
(Continued)

FOREIGN PATENT DOCUMENTS

CN 1595718 A 3/2005
CN 1262133 C 6/2006
(Continued)

OTHER PUBLICATIONS

Chen et al., "Mobile Communication System and Mobile Phone Repair Technology," 2nd Edition, China Machine Press, Aug. 2012, pp. 14-17 (8 pages total), with English abstract.
(Continued)

*Primary Examiner* — Tho G Phan
(74) *Attorney, Agent, or Firm* — Birch, Stewart, Kolasch & Birch, LLP

(57) ABSTRACT

A mobile device includes a dielectric substrate, a metal layer, a metal housing, a nonconductive partition, at least one connection element, and a feeding element. The metal layer is disposed on the dielectric substrate, and includes an upper element and a main element, wherein a slot is formed between the upper element and the main element. The metal housing is substantially a hollow structure, and has a slit, wherein the slit is substantially aligned with the slot of the metal layer. The connection element couples the upper element of the metal layer to the metal housing. The feeding element is coupled to the upper element of the metal layer or coupled to the metal housing. An antenna structure is formed by the feeding element, the upper element of the metal layer, the connection element, and the metal housing.

41 Claims, 59 Drawing Sheets

(56) References Cited

U.S. PATENT DOCUMENTS

| | | | | |
|---|---|---|---|---|
| 6,686,887 | B2 | 2/2004 | Kasuya et al. | |
| 7,053,848 | B2 | 5/2006 | Shoji et al. | |
| 7,091,920 | B2 * | 8/2006 | Yuanzhu | H01Q 13/10 343/767 |
| 7,903,036 | B2 | 3/2011 | Takaki et al. | |
| 8,102,319 | B2 * | 1/2012 | Schlub | H01Q 1/243 343/702 |
| 8,270,914 | B2 * | 9/2012 | Pascolini | H01Q 1/243 455/90.2 |
| 8,432,321 | B2 * | 4/2013 | Arkko | H01Q 1/243 343/702 |
| 8,681,056 | B2 | 3/2014 | Hobson et al. | |
| 9,166,279 | B2 | 10/2015 | Jin et al. | |
| 2004/0246188 | A1 | 12/2004 | Egashira | |
| 2005/0052329 | A1 | 3/2005 | Tsukamoto | |
| 2008/0316116 | A1 | 12/2008 | Hobson et al. | |
| 2009/0153411 | A1 | 7/2009 | Chiang et al. | |
| 2012/0009884 | A1 | 1/2012 | Rao et al. | |
| 2012/0009983 | A1 | 1/2012 | Mow et al. | |
| 2012/0229347 | A1 | 9/2012 | Jin et al. | |
| 2012/0268343 | A1 | 10/2012 | Yanagi et al. | |
| 2013/0257659 | A1 | 10/2013 | Darnell et al. | |
| 2014/0015724 | A1 | 1/2014 | Bungo | |

FOREIGN PATENT DOCUMENTS

| | | | |
|---|---|---|---|
| CN | 101075699 | A | 11/2007 |
| CN | 101366147 | A | 2/2009 |
| CN | 101578018 | A | 11/2009 |
| CN | 101641826 | A | 2/2010 |
| CN | 101897079 | A | 11/2010 |
| CN | 201805000 | U | 4/2011 |
| CN | 201893435 | U | 7/2011 |
| CN | 10214855 | A | 8/2011 |
| CN | 102368575 | A | 3/2012 |
| CN | 102394372 | A | 3/2012 |
| CN | 102437406 | A | 5/2012 |
| CN | 102456943 | A | 5/2012 |
| CN | 102544702 | A | 7/2012 |
| CN | 202352827 | U | 7/2012 |
| CN | 202353553 | U | 7/2012 |
| CN | 102763295 | A | 10/2012 |
| EP | 1 804 469 | A2 | 7/2007 |
| EP | 1 950 834 | B1 | 2/2012 |
| FR | 2889360 | A1 | 2/2007 |
| JP | 2004-215132 | A | 7/2004 |
| TW | I-260817 | B | 8/2006 |
| TW | 200640075 | A | 11/2006 |
| TW | M417671 | U1 | 12/2011 |
| TW | M438077 | U1 | 9/2012 |
| TW | 201240205 | A1 | 10/2012 |
| TW | 201242162 | A1 | 10/2012 |

OTHER PUBLICATIONS

Kraus et al., "Antennas: For All Applications," Third Edition, Publishing House of Electronics Industry, Apr. 2011, pp. 238-239 (7 pages total), with English abstract.

Liu et al., "Antennas in Mobile Communication System," Publishing House of Electronics Industry, May 2011, pp. 161-165 (9 pages total), with English abstract.

Lingyun, "Research on New Antenna Technology for Mobile Terminals," Apr. 15, 2011, pp. 1-64 (69 pages), with an English abstract.

* cited by examiner

MOBILE DEVICE AND ANTENNA STRUCTURE

CROSS-REFERENCE TO RELATED APPLICATIONS

This application is a Continuation of copending U.S. application Ser. No. 13/672,464, filed on Nov. 8, 2012, all of which are hereby expressly incorporated by reference into the present application.

BACKGROUND OF THE INVENTION

Field of the Invention

The subject application generally relates to a mobile device and, more particularly, to a mobile device comprising an antenna structure with metal housing.

Description of the Related Art

With the progress of mobile communication technology, handheld devices like portable computers, mobile phones, multimedia players, and other hybrid functional portable electronic devices have become more common. To satisfy the user demand, handheld devices can usually perform wireless communication functions. Some devices cover a large wireless communication area, such as mobile phones using 2G, 3G, 4G and LTE (Long Term Evolution) systems and using frequency bands of 700 MHz, 800 MHz, 850 MHz, 900 MHz, 1800 MHz, 1900 MHz, 2100 MHz, 2300 MHz, 2500 MHz and 2600 MHz. Some devices cover a small wireless communication area, for example, mobile phones using Wi-Fi, Bluetooth, and WiMAX (Worldwide Interoperability for Microwave Access) systems and using frequency bands of 2.4 GHz, 3.5 GHz, 5.2 GHz, and 5.8 GHz.

In addition, recent handheld devices are preferably designed with thin metal housings. However, the traditional antenna design is negatively affected by shields of metal housings and internal electronic components, and has poor radiation efficiency. For that reason, traditional antenna design uses plastic or another non-metal material as an antenna carrier or an antenna cover within an antenna region, and this design ruins the whole appearance. It is a critical challenge to design an antenna structure integrated with a metal appearance and further maintain a consistent, whole appearance.

BRIEF SUMMARY OF THE INVENTION

In one exemplary embodiment, the subject application is directed to a mobile device comprising: a dielectric substrate; a metal layer lying on the dielectric substrate and comprising an upper element and a main element, wherein a first slot is formed between the upper element and the main element; a metal housing, being substantially a hollow structure, and having a first slit, wherein the dielectric substrate and the metal layer are disposed inside the metal housing, and the first slit is substantially aligned with the first slot of the metal layer; a first nonconductive partition partially disposed in the first slit of the metal housing; one or more connection elements, coupling the upper element of the metal layer to the metal housing; and a first feeding element coupled to the upper element of the metal layer, wherein a first antenna structure is formed by the first feeding element, the upper element of the metal layer, the connection element, the first slot and the metal housing.

In another exemplary embodiment, the subject application is directed to a mobile device, comprising: a dielectric substrate, comprising a first protruded portion; a metal layer lying on the dielectric substrate and comprising an upper element and a main element, wherein a first slot is formed between the upper element and the main element; a metal housing, being substantially a hollow structure and having a first slit and a second slit, wherein the dielectric substrate and the metal layer are disposed inside the metal housing, the first slit is substantially aligned with the first slot of the metal layer, and a projection of the second slit partially overlaps the first protruded portion; a first nonconductive partition, partially disposed in the first slit of the metal housing; a second nonconductive partition, partially disposed in the second slit of the metal housing; a first connection element, disposed on the first protruded portion of the dielectric substrate, wherein a signal source is coupled through the first connection element to the metal housing; and a second connection element, wherein the metal housing is coupled through the second connection element to the main element of the metal layer, wherein a first antenna structure is formed by the first connection element, the second connection element and the metal housing.

BRIEF DESCRIPTION OF DRAWINGS

The subject application can be more fully understood by reading the subsequent detailed description and examples with references made to the accompanying drawings, wherein.

DETAILED DESCRIPTION OF THE INVENTION

The subject application is mainly related to a metal housing (or a metal appearance element) and disposition of a PCB (Printed Circuit Board) with different shapes. An antenna structure can operate in the desired resonant band by appropriately adjusting the antenna feeding point, the feeding matching impedance, and the length and width of the slot on the PCB. In addition, the antenna structure is electrically coupled to the metal housing such that the metal housing is considered an extension of the antenna structure. Accordingly, the metal housing neither shields nor negatively affects the radiation of the antenna structure. The subject application further provides a mobile phone design integrated with a whole metal housing. The detailed descriptions and implements are illustrated as follows.

Figure 1:
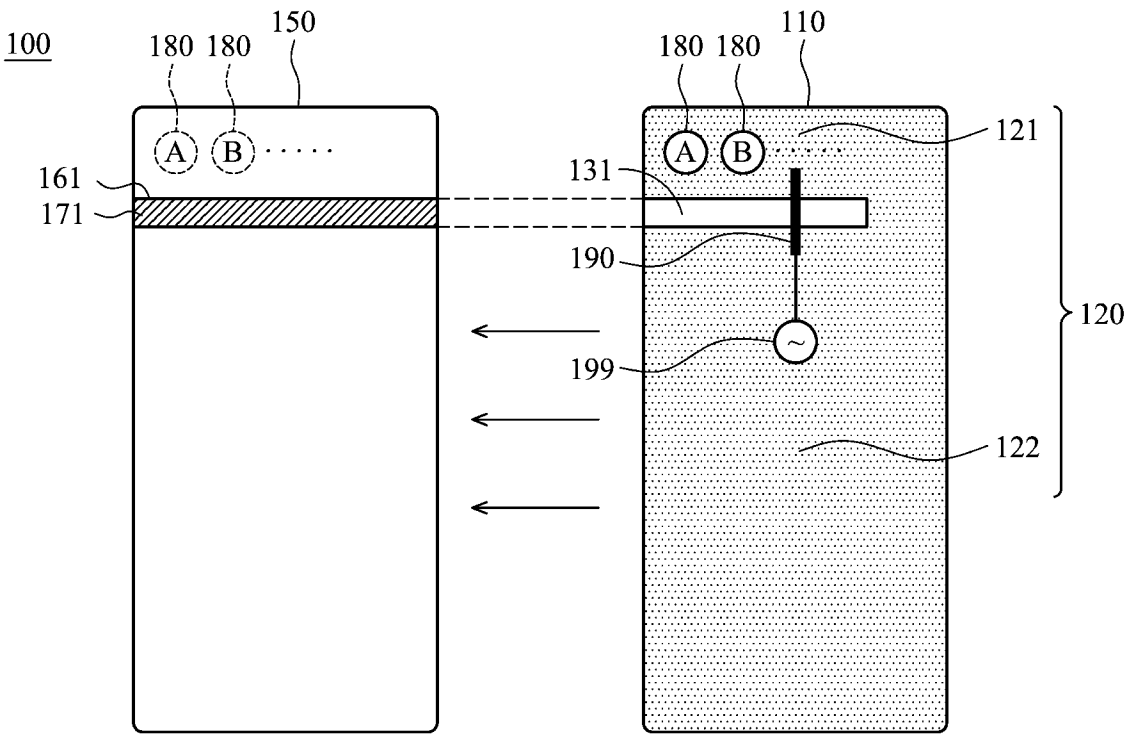
FIG. 1 is a diagram illustrating a mobile device according to an embodiment of the invention.
Figure 2A:
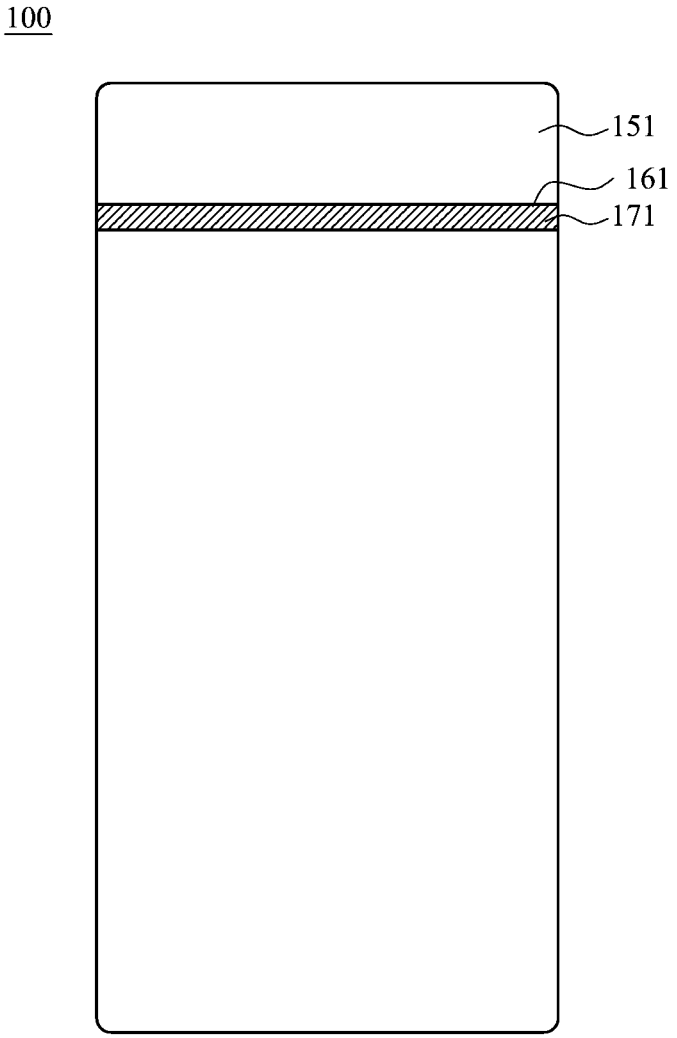
FIGS. 2A-2F are six-sided views of a mobile device according to an embodiment of the invention.
Figure 2B:
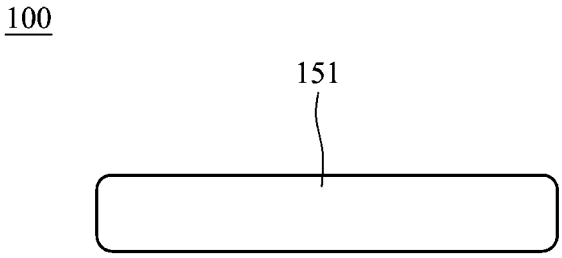
Figure 2C:
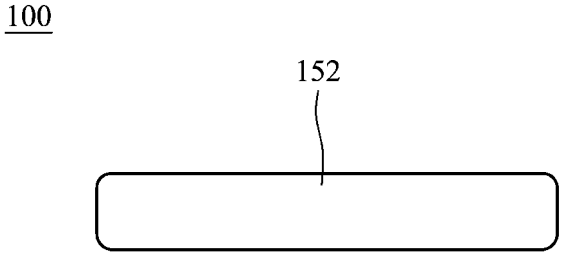
Figure 2D:
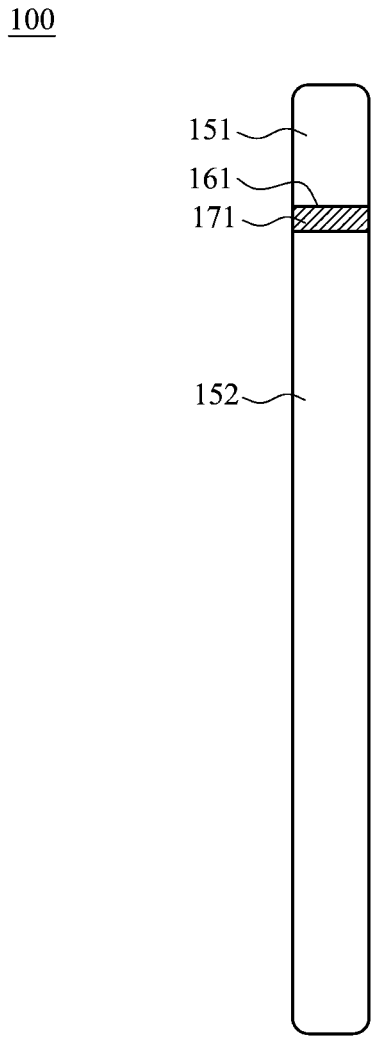
Figure 2E:
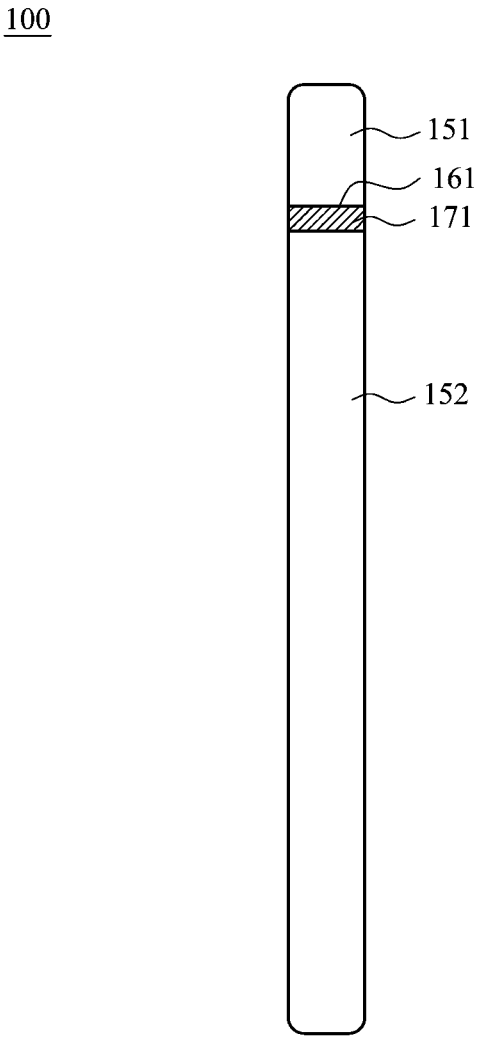
Figure 2F:
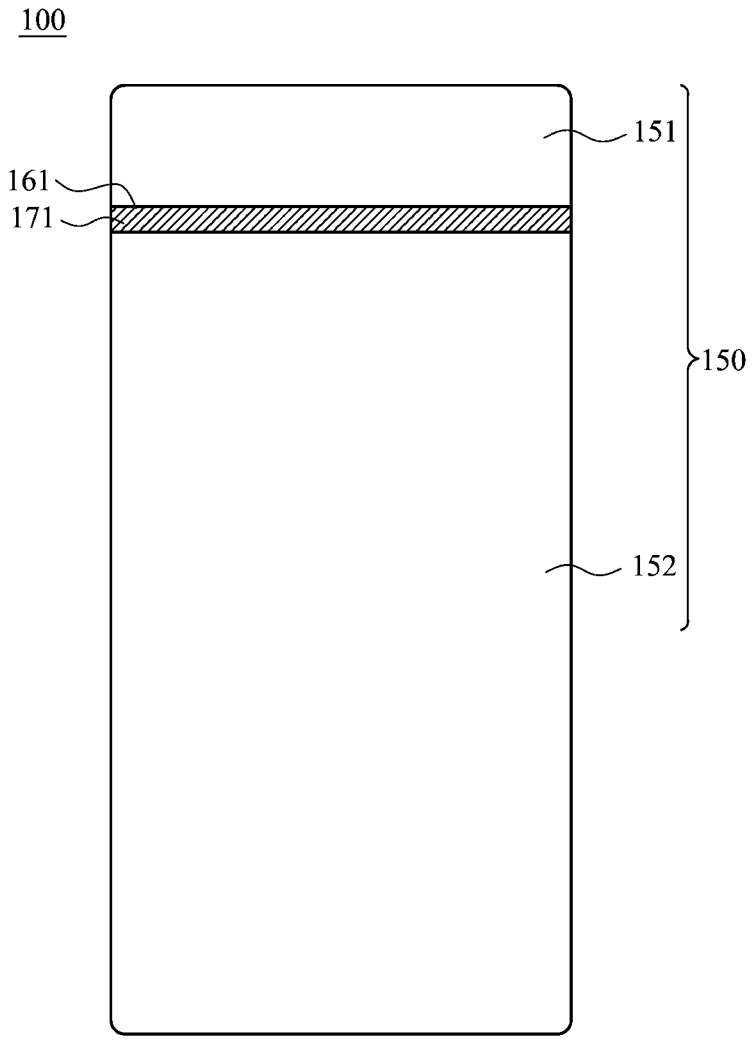

FIG. 1 is a diagram illustrating a mobile device 100 according to an embodiment of the invention. The mobile device 100 may be a cellular phone, a tablet computer, or a notebook computer. As shown in FIG. 1, the mobile device 100 at least comprises a dielectric substrate 110, a metal layer 120, a metal housing 150, a first nonconductive partition 171, one or more connection elements 180, and a feeding element 190. In some embodiments, the connection elements 180 and the feeding element 190 are made of a metal such as silver, copper, or aluminum. The dielectric substrate 110 may be an FR4 substrate or a hard/soft composite board. The mobile device 100 may further comprise other essential components, including a processing module, a touch module, a display module, a transparent panel, and a battery (not shown). Among them, the touch module may be integrated with the display module to form a touch-display module.

The metal layer 120 lies on the dielectric substrate 110 and comprises an upper element 121 and a main element 122. At least a first slot 131 is formed between the upper element 121 and the main element 122. The metal housing 150 is substantially a hollow structure and has at least a first slit 161. It is understood that the dielectric substrate 110 and the metal layer 120 are both disposed inside the metal housing 150 and that the first slit 161 of the metal housing 150 is substantially aligned with the first slot 131 of the metal layer 120. In a preferred embodiment, the opening area of the first slit 161 of the metal housing 150 is greater than or equal to that of the first slot 131 of the metal layer 120. For example, the first slit 161 of the metal housing 150 may have a greater length, a greater width, or both to achieve better antenna efficiency. Concerning the appearance of the whole design, in other embodiments, the opening area of the first slit 161 may be smaller than that of the first slot 131. For example, the first slit 161 of the metal housing 150 may have a smaller length, a smaller width, or both. This design causes the radiation efficiency to be decreased slightly, but still allowable. The first nonconductive partition 171 is partially disposed in the first slit 161 of the metal housing 150, for example by being embedded, filled or injected. The first slit 161 may partially or completely separate the metal housing 150. The first nonconductive partition 171 may be partially disposed in the first slit 161 in response to the opening size of the first slit 161. In some embodiments, the configuration area of the first nonconductive partition 171 is greater than or equal to the opening area of the first slit 161. In an embodiment, the first nonconductive partition 171 is made of a plastic material. The plastic material may be transparent or opaque, and different colors or patterns may be coated on the plastic material to make it beautiful and decorated. Note that neither any metal (e.g., copper) nor any electronic component is disposed within the first slot 131. The first slot 131 is defined by the laying region where the metal layer 120 lies. A perpendicular projection region of the first slot 131 is formed on the dielectric substrate 110, and the dielectric substrate 110 is penetrated or not penetrated within the projection region. The shape of the first nonconductive partition 171 is similar to that of the first slit 161. For example, if the first slit 161 is merely formed on the upper half of the metal housing 150, the first nonconductive partition 171 may have a substantially inverted U-shape.

At least one connection element 180 couples the upper element 121 of the metal layer 120 to the metal housing 150. In the mobile device 100, an antenna structure is formed by the feeding element 190, the upper element 121 of the metal layer 120, the first slot 131, one or more connection elements 180 and the metal housing 150. The upper element 121 of the metal layer 120 is the main radiation element thereof. The feeding element 190 may be coupled to the upper element 121 of the metal layer 120 or may be coupled to the metal housing to excite the antenna structure. In the embodiment, one end of the feeding element 190 extends across the first slot 131 and is coupled to the upper element 121 of the metal layer 120, and the other end of the feeding element 190 is coupled to a signal source 199. The signal source 199 is further coupled to an RF (Radio Frequency) signal processing module (not shown). The feeding element 190 and the metal layer 120 may be disposed on different planes. In another embodiment, the feeding element 190 is coupled through a metal spring (not shown) to the metal housing 150 to excite the antenna structure. In addition, the feeding element 190 may comprise a variable capacitor (not shown). By adjusting the capacitance of the variable capacitor, the antenna structure of the mobile device 100 can operate in multiple bands.

Since the metal housing 150 is coupled to the upper element 121 of the metal layer 120, the metal housing 150 is considered a portion of the antenna structure of the mobile device 100, i.e., an extension radiation element. Accordingly, the metal housing 150 does not affect radiation performance of the antenna structure, and further provides a longer resonant path for the antenna structure. Similarly, the feeding element 190 is another portion of the antenna structure of the mobile device 100. Even if the feeding element 190 extends across the first slot 131, the feeding element 190 does not affect the radiation performance of the antenna structure. Electromagnetic waves may be transmitted or received through the first slit 161 of the metal housing 150 by the antenna structure. Accordingly, the antenna structure can maintain good radiation efficiency. In addition, the number of connection elements 180 and the connection position of the metal housing 150 also affect the operation of the whole mobile device 100. For example, the operation band of the antenna structure is changed by adjusting the length of the resonant path. When the first slit 161 partially or completely separates the metal housing 150, the operation of the whole mobile device 100 is improved. If the housing of the mobile device 100 is made of non-metal material, i.e., the antenna region is not shielded by any metal housing, another antenna structure may be formed by the feeding element 190, the upper element 121 of the metal layer 120, and the first slot 131. In such cases, the upper element 121 of the metal layer 120 is the main radiation element. The above design associated to the radiation element and the relative embodiments and features are all combined and disclosed in U.S. patent application Ser. No. 13/598,317.

FIGS. 2A-2F are six-sided views of a mobile device 100 according to an embodiment of the invention. In FIGS. 2A-2F, some essential components inside the metal housing 150 are not displayed. As shown in FIGS. 2A-2F, the metal housing 150 comprises an upper cover 151 and a middle cover 152, and the first slit 161 completely separates the upper cover 151 from the middle cover 152. The first nonconductive partition 171 is substantially a ring structure, which is partially disposed in the first slit 161 of the metal housing 150 and surrounds the dielectric substrate 110 and the metal layer 120. In the embodiment, the metal housing 150 has the first slit 161 with a ring structure such that the antenna structure can transmit or receive electromagnetic waves easily. In other embodiments, the first slit 161 may be designed as a non-ring structure. Note that the mobile device 100 may further comprise at least a processing module, a display module, a touch module, a transparent panel, or a touch-display module with a transparent panel (not shown), and a portion of the metal housing 150 may be replaced with the transparent panel. In other embodiments, a portion of the transparent panel, e.g., an edge thereof, is partially disposed in the first slit 161 of the metal housing 150 to form all or a portion of the first nonconductive partition 171.

Figure 3:
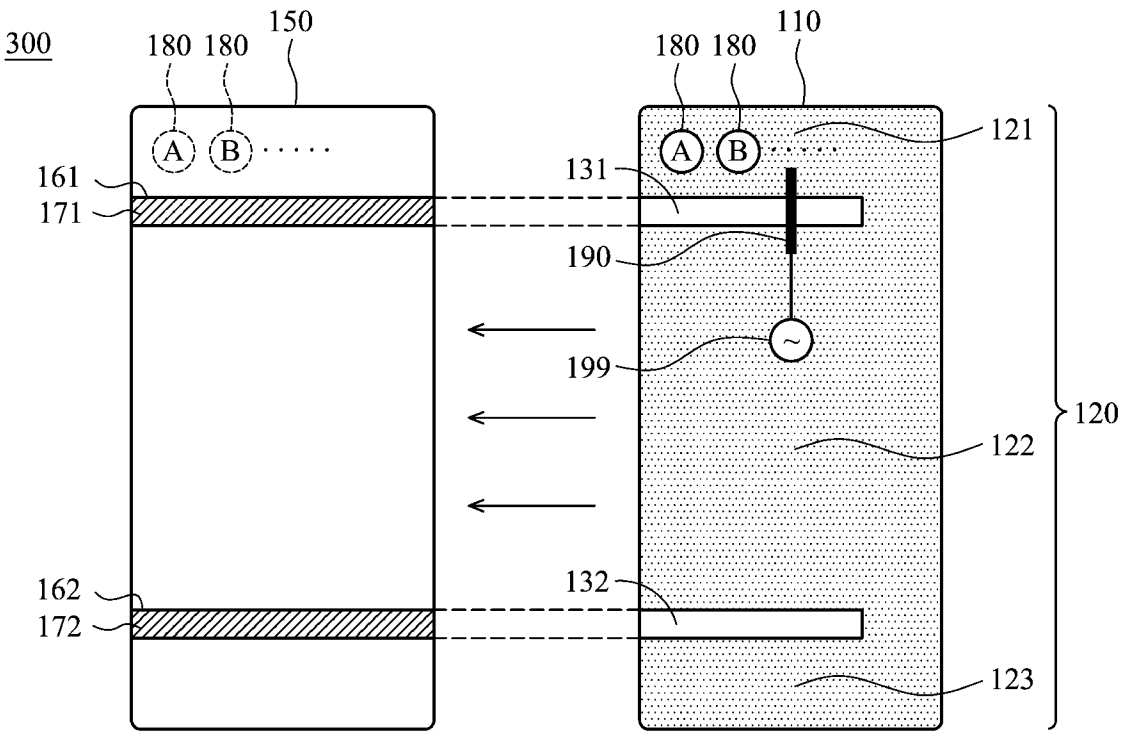
FIG. 3 is a diagram illustrating a mobile device according to another embodiment of the invention.
Figure 4A:
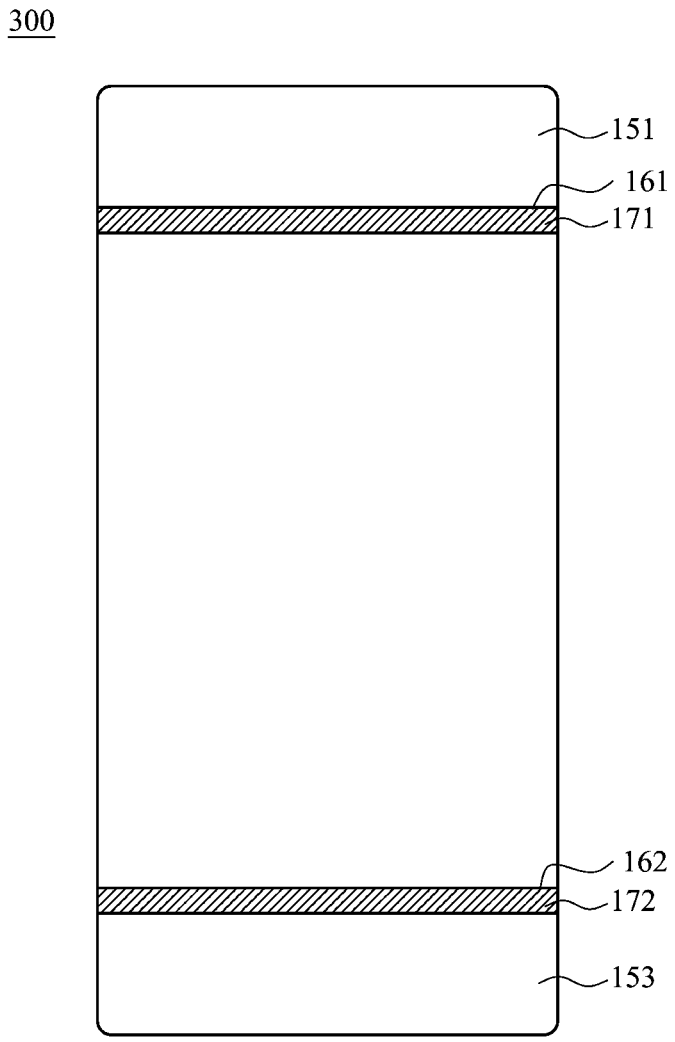
FIGS. 4A-4F are six-sided views of a mobile device according to an embodiment of the invention.
Figure 4B:
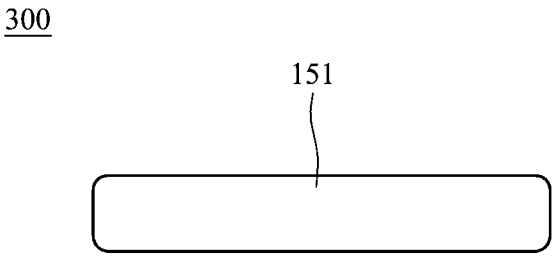
Figure 4C:
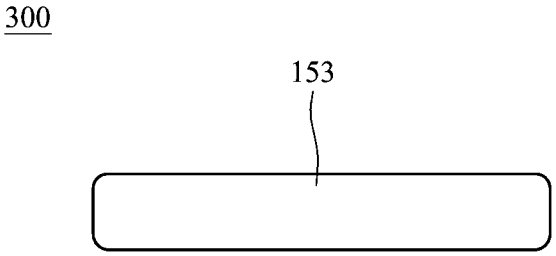
Figure 4D:
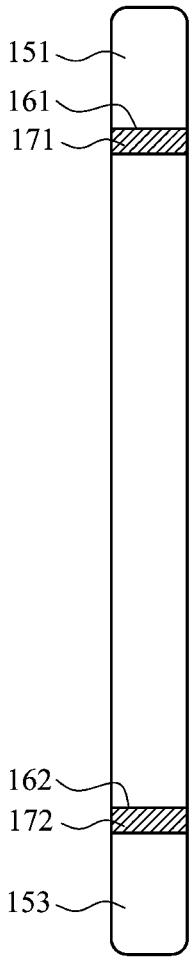
Figure 4E:
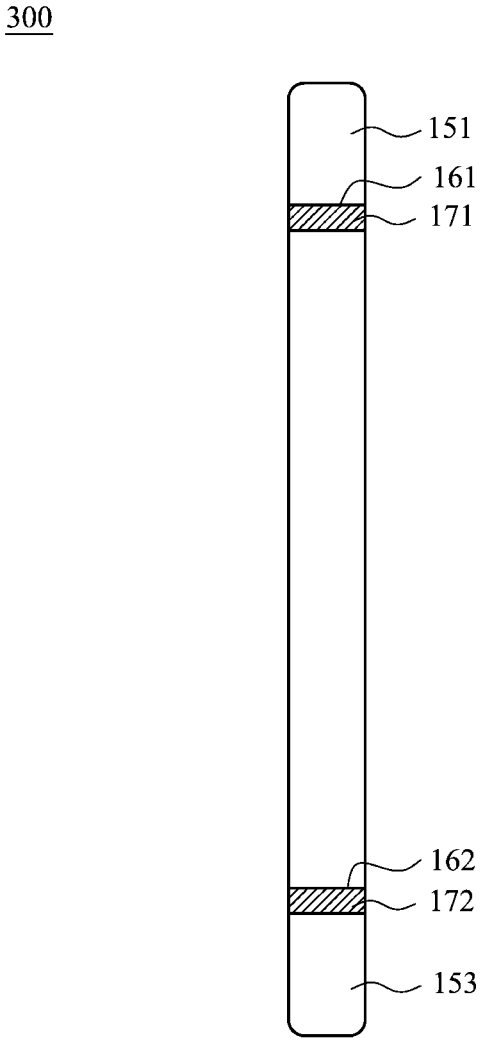
Figure 4F:
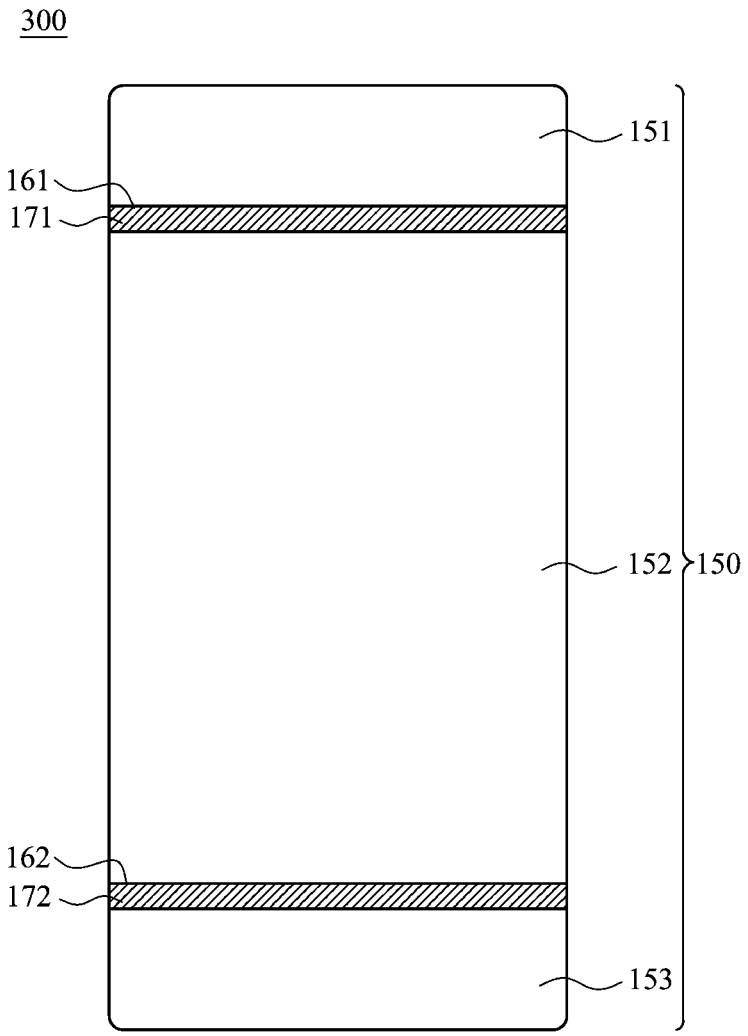

FIG. 3 is a diagram illustrating a mobile device 300 according to another embodiment of the invention. The mobile device 300 is similar to the mobile device 100 of FIG. 1. The differences between the two embodiments are as follows. The metal layer 120 of the mobile device 300 further comprises a lower element 123, and a second slot 132 is formed between the main element 122 and the lower element 123. Correspondingly, the metal housing 150 of the mobile device 300 further has a second slit 162, and the second slit 162 is substantially aligned with the second slot 132 of the metal layer 120. The mobile device 300 further comprises a second nonconductive partition 172, and the second nonconductive partition 172 is partially disposed in the second slit 162 of the metal housing 150, for example, by being embedded, filled or injected. The second slit 162 may partially or completely separate the metal housing 150. The opening area of the second slit 162 is greater than or equal to that of the second slot 132. For example, the second slit 162 of the metal housing 150 may have a greater length, a greater width, or both to achieve better antenna efficiency. Concerning the appearance of the overall design, in other embodiments, the opening area of the second slit 162 may be smaller than that of the second slot 132. For example, the second slit 162 of the metal housing 150 may have a smaller length, a smaller width, or both. This design causes the radiation efficiency to be decreased slightly, but still allowable. The second nonconductive partition 172 may be disposed in the second slit 162 in response to the opening size of the second slit 162. In some embodiments, the configuration area of the second nonconductive partition 172 is greater than or equal to the opening area of the second slit 162. In some embodiments, at least one other connection element (not shown) couple the lower element 123 of the metal layer 120 to the metal housing 150 such that another antenna structure is formed. In other words, the mobile device 300 may comprise a main antenna structure and an auxiliary antenna structure. Note that neither any metal (e.g., copper) nor any electronic component is disposed within the second slot 132. The second slot 132 is defined by the laying region where the metal layer 120 lies. A perpendicular projection region of the second slot 132 is formed on the dielectric substrate 110, and the dielectric substrate 110 is penetrated or not penetrated within the projection region.

FIGS. 4A-4F are six-sided views of the mobile device 300 according to an embodiment of the invention. In FIGS. 4A-4F, some essential components inside the metal housing 150 are not displayed. As shown in FIGS. 4A-4F, the metal housing 150 comprises an upper cover 151, a middle cover 152, and a lower cover 153. The first slit 161 partially or completely separates the upper cover 151 from the middle cover 152, and the second slit 162 partially or completely separates the middle cover 152 from the lower cover 153. The first nonconductive partition 171 is substantially a ring structure, which is partially disposed in the first slit 161 of the metal housing 150 and surrounds the dielectric substrate 110 and the metal layer 120. The second nonconductive partition 172 is also substantially a ring structure, which is partially disposed in the second slit 162 of the metal housing 150 and surrounds the dielectric substrate 110 and the metal layer 120. In other embodiments, each of the first slit 161 and the second slit 162 substantially has a non-ring structure to improve the operation performance of the mobile device 300. Similarly, a portion of the metal housing 150 may be replaced with a transparent panel or a touch-display module with a transparent panel. In other embodiments, an upper portion and a lower portion of the transparent panel, e.g., edges thereof, are partially disposed in the first slit 161 and the second slit 162 of the metal housing 150 to form all or a portion of the first nonconductive partition 171 and to form all or a portion of the second nonconductive partition 172.

FIGS. 5A-5F are six-sided views of a mobile device 500 according to another embodiment of the invention. In FIGS. 5A-5F, some essential components inside the metal housing 150 are not displayed. The mobile device 500 is similar to the mobile device 300 of FIGS. 4A-4F. The differences between the two embodiments are as follows. The mobile device 500 at least further comprises a transparent panel 510 or a touch-display module with a transparent panel (e.g., a display module or a touch module). The transparent panel 150 is opposite to the middle cover 152 of the metal housing 150, and is located between the upper cover 151 and the lower cover 153 of the metal housing 150. In addition, the mobile device 500 further comprises a third nonconductive partition 173 and a fourth nonconductive partition 174. The third nonconductive partition 173 and the fourth nonconductive partition 174 completely separate the transparent panel 510 from the middle cover 152 of the metal housing 150. In the embodiment, the radiation element of the antenna structure does not include the middle cover 152, and each of the third nonconductive partition 173 and the fourth nonconductive partition 174 substantially has an I-shape.

Figure 5A:
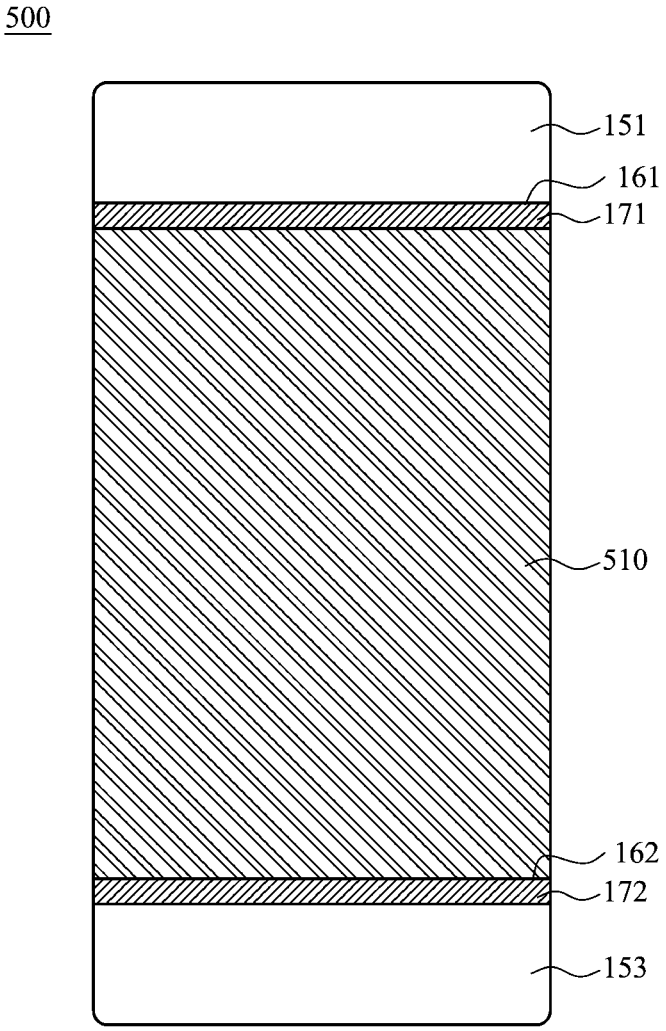
FIGS. 5A-5F are six-sided views of a mobile device according to another embodiment of the invention.
Figure 5B:
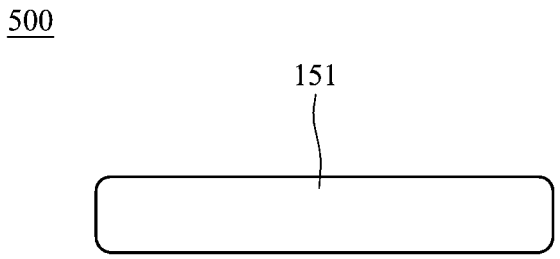
Figure 5C:
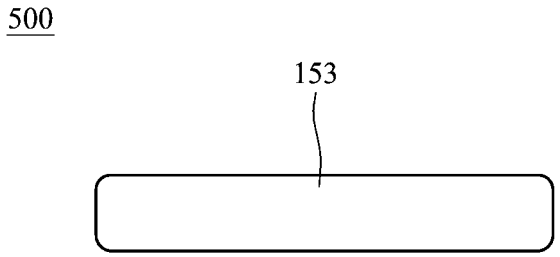
Figure 5D:
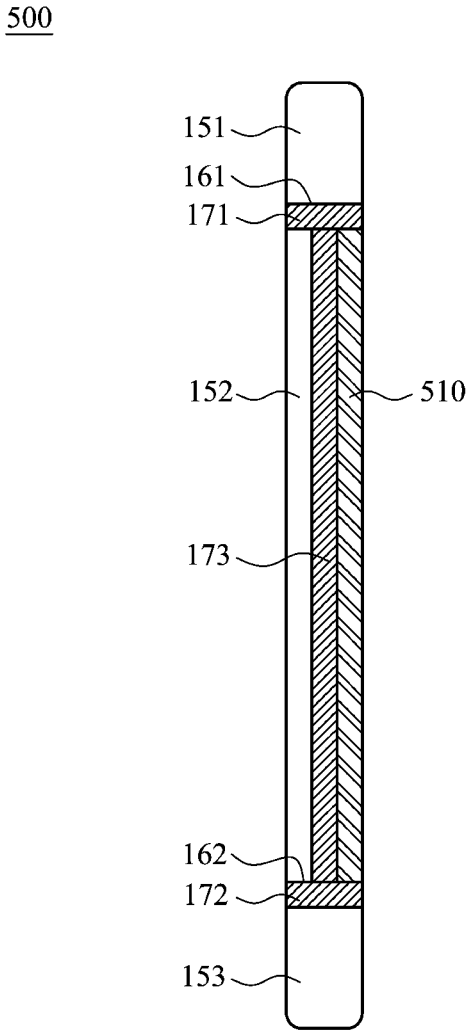
Figure 5E:
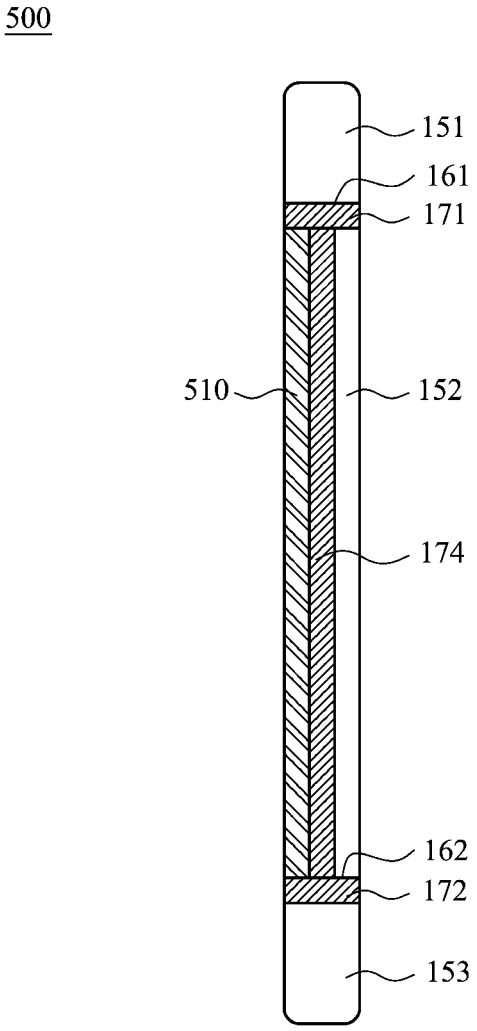
Figure 5F:
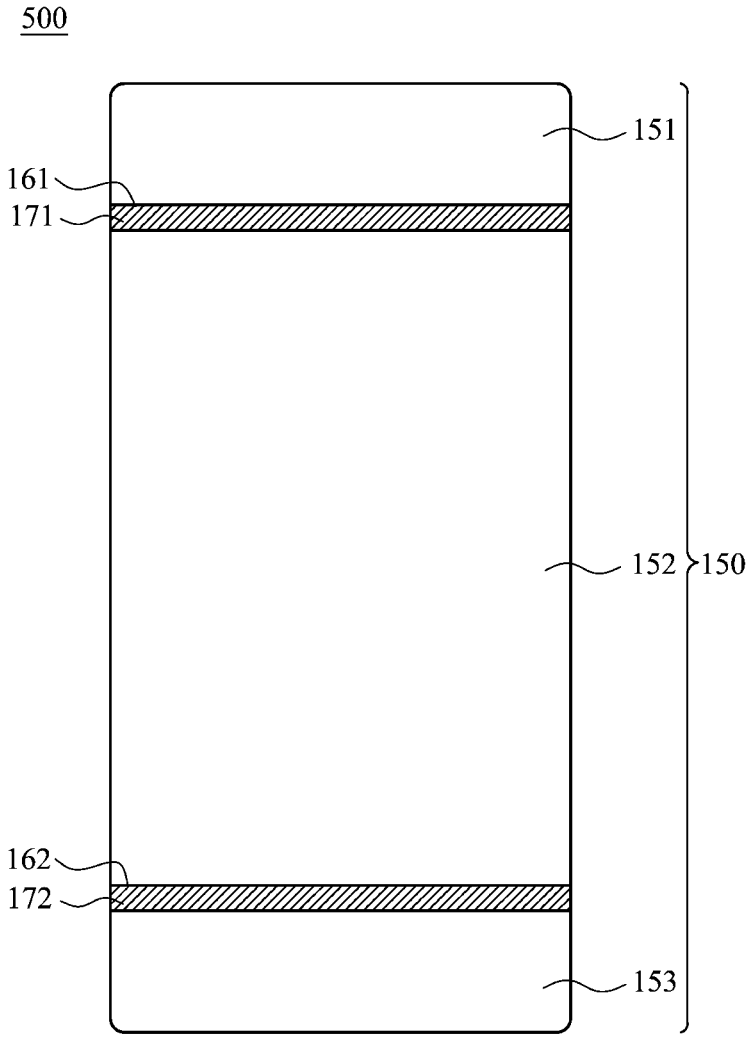
Figure 5G:
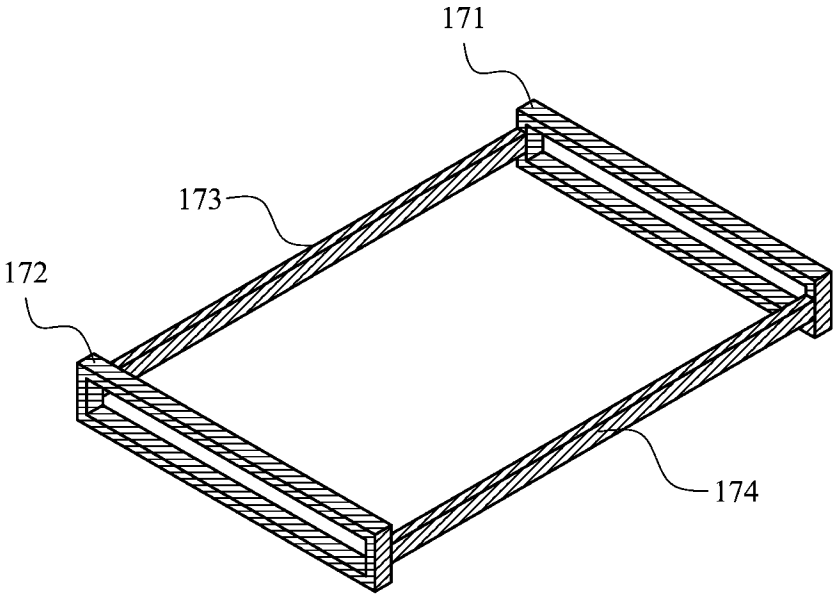
FIG. 5G is a pictorial view of all the nonconductive partitions of a mobile device according to an embodiment of the invention.

FIG. 5G is a pictorial view of all the nonconductive partitions of the mobile device 500 according to an embodiment of the invention. As shown in FIG. 5G, in the mobile device 500, the first nonconductive partition 171, the second nonconductive partition 172, the third nonconductive partition 173, and the fourth nonconductive partition 174 are integrally formed (one-piece) and, for example, are made of a plastic material.

FIGS. 6A-6F are six-sided views of a mobile device 600 according to an embodiment of the invention. In FIGS. 6A-6F, some essential components inside the metal housing 150 are not displayed. The mobile device 600 is similar to the mobile device 500 of FIGS. 5A-5F. The differences between the two embodiments are as follows. The upper cover 151 of the metal housing 150 of the mobile device 600 comprises a first upper sub-cover 151-1 and a second upper sub-cover 151-2, and the first upper sub-cover 151-1 is partially or completely separated from the second upper sub-cover 151-2. The lower cover 153 of the metal housing 150 of the mobile device 600 comprises a first lower sub-cover 153-1 and a second lower sub-cover 153-2, and the first lower sub-cover 153-1 is partially or completely separated from the second lower sub-cover 153-2. In addition, the mobile device 600 further comprises a fifth nonconductive partition 175 and a sixth nonconductive partition 176. The fifth nonconductive partition 175 partially or completely separates the first upper sub-cover 151-1 from the second upper sub-cover 151-2. The sixth nonconductive partition 176 partially or completely separates the first lower sub-cover 153-1 from the second lower sub-cover 153-2. In the embodiment, the upper sub-covers and lower sub-covers are completely separate, and the radiation element of the antenna structure does not include the middle cover 152, and each of the fifth nonconductive partition 175 and the sixth nonconductive partition 176 substantially has a U-shape.

Figure 6A:
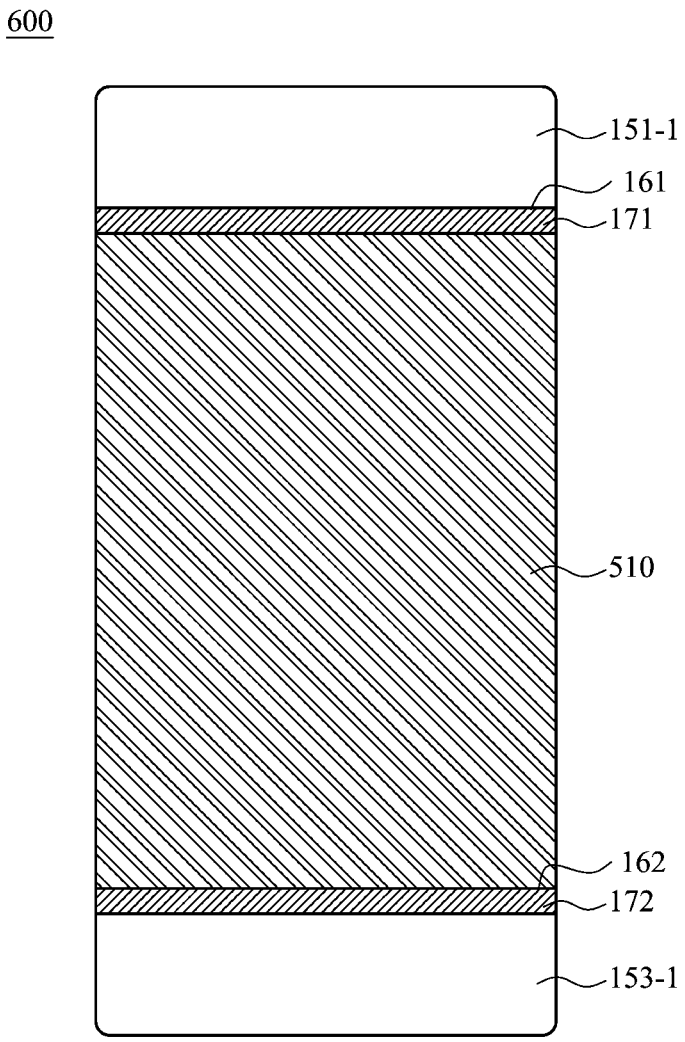
FIGS. 6A-6F are six-sided views of a mobile device according to an embodiment of the invention.
Figure 6B:
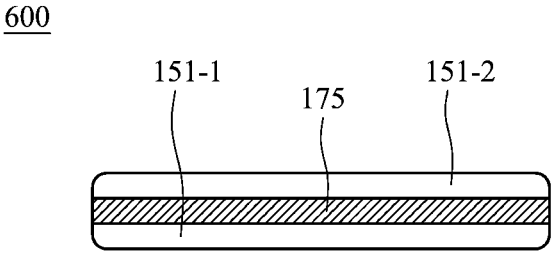
Figure 6C:
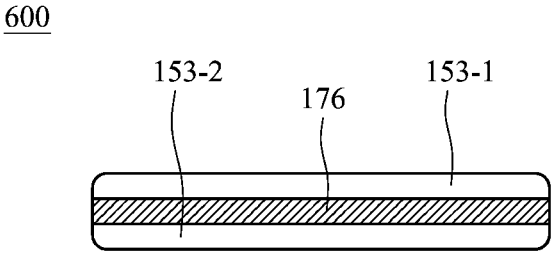
Figure 6D:
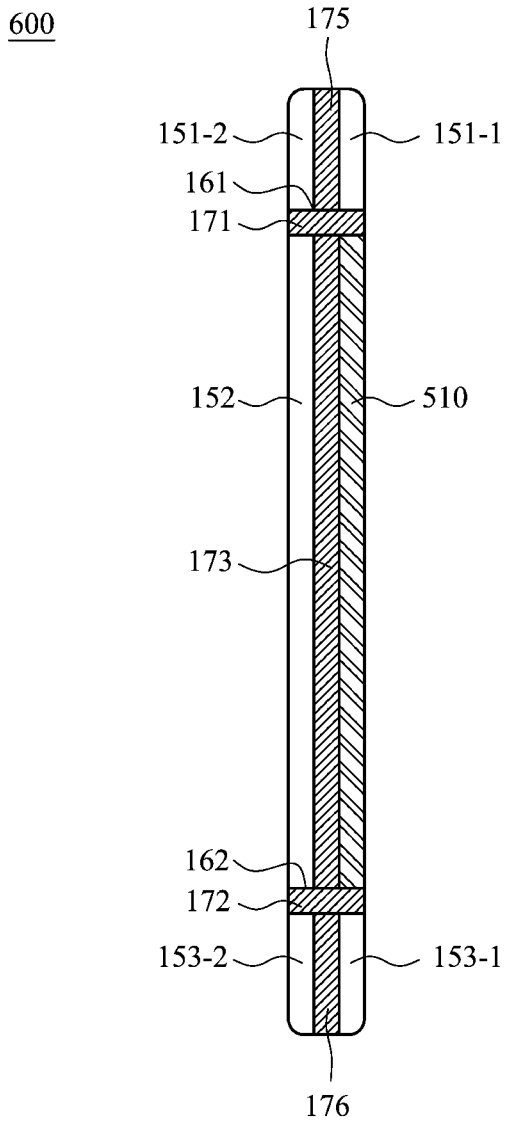
Figure 6E:
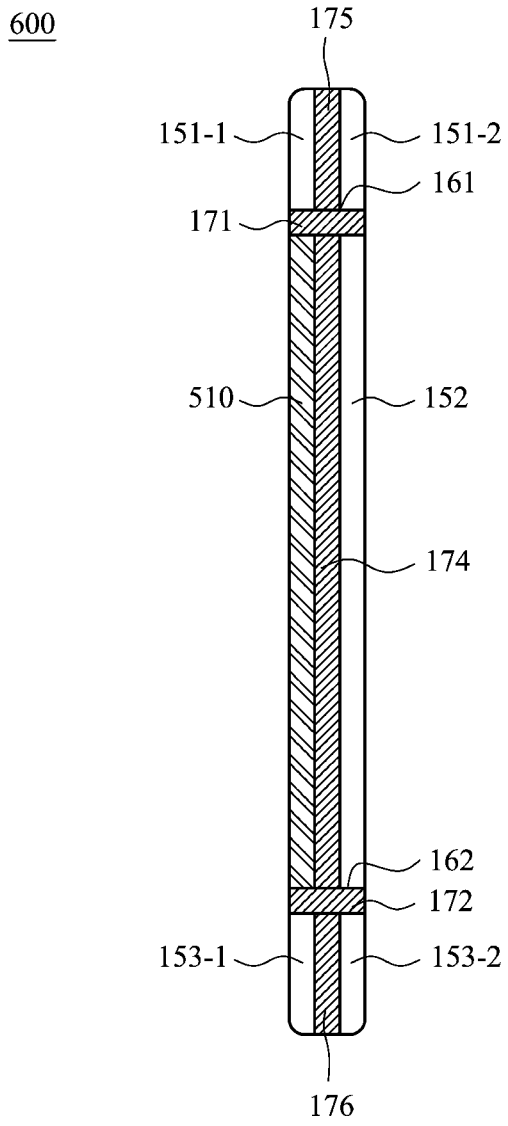
Figure 6F:
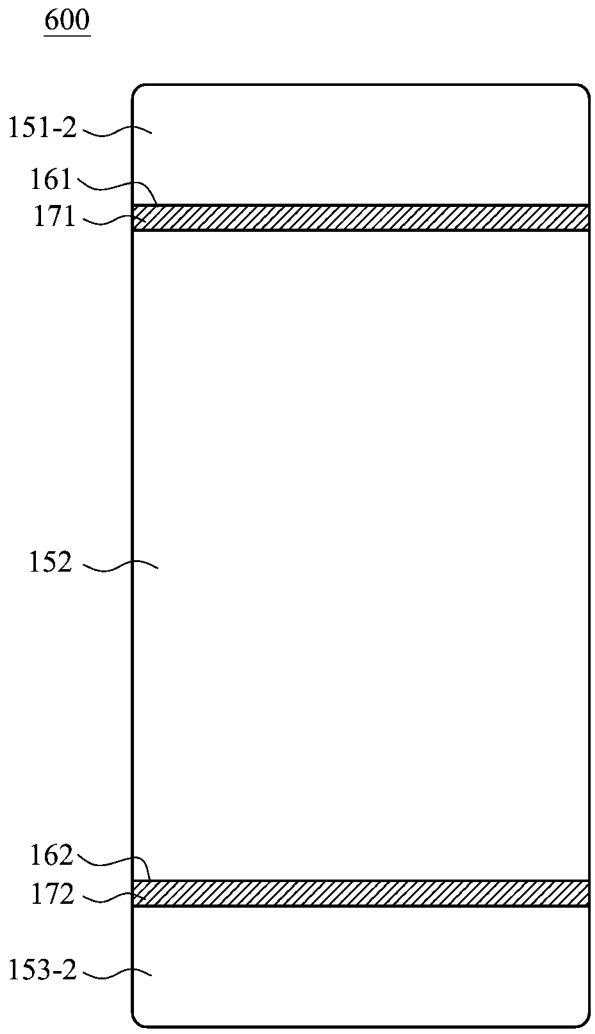
Figure 6G:
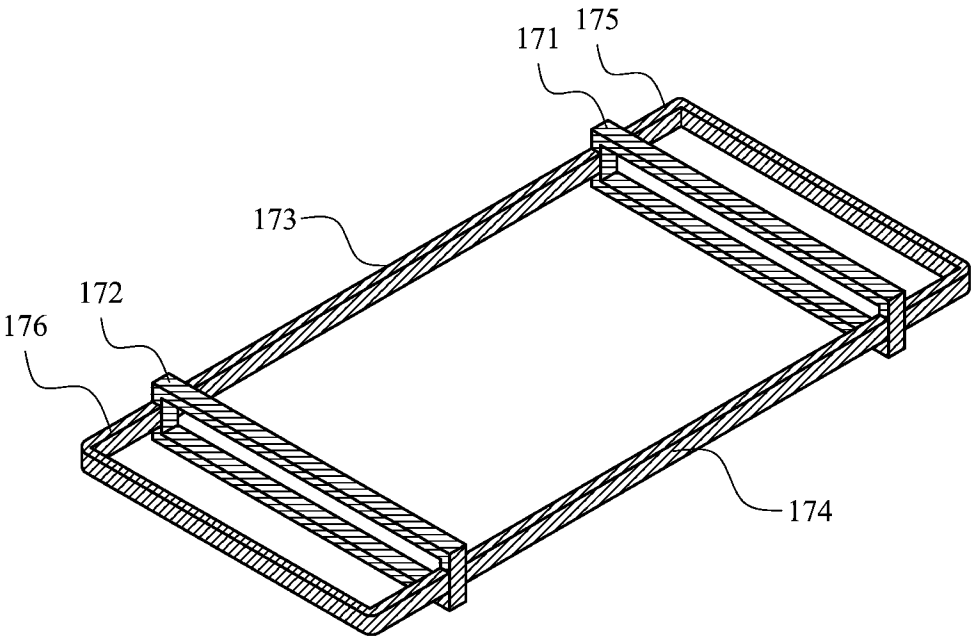
FIG. 6G is a pictorial view of all the nonconductive partitions of a mobile device according to an embodiment of the invention.

FIG. 6G is a pictorial view of all the nonconductive partitions of the mobile device 600 according to an embodiment of the invention. As shown in FIG. 6G, in the mobile device 600, the first nonconductive partition 171, the second nonconductive partition 172, the third nonconductive partition 173, the fourth nonconductive partition 174, the fifth nonconductive partition 175, and the sixth nonconductive partition 176 are integrally formed (one-piece) and, for example, are made of a plastic material.

Figures 7A, 7B, 7C:
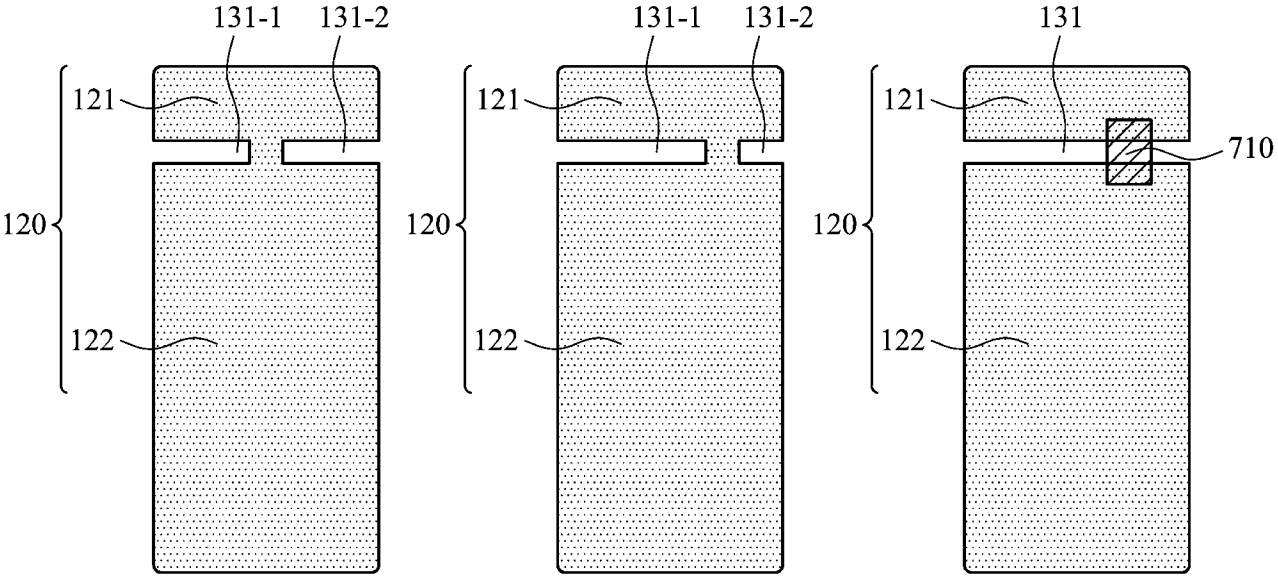
FIG. 7A is a diagram illustrating a metal layer according to an embodiment of the invention.
FIG. 7B is a diagram illustrating a metal layer according to another embodiment of the invention.
FIG. 7C is a diagram illustrating a metal layer according to an embodiment of the invention.

FIG. 7A is a diagram illustrating the metal layer 120 according to an embodiment of the invention. As shown in FIG. 7A, the first slot 131 of the metal layer 120 comprises a first portion 131-1 and a second portion 131-2, and the first portion 131-1 is separated from the second portion 131-2. Note that as mentioned above, the feeding element 190 may extend across the first portion 131-1 or the second portion 131-2 and may be coupled to the upper element 121 of the metal layer 120 to excite an antenna structure. In the embodiment, the first portion 131-1 and the second portion 131-2 are substantially arranged in a straight line, and the length of the first portion 131-1 is substantially equal to the length of the second portion 131-2.

FIG. 7B is a diagram illustrating the metal layer 120 according to another embodiment of the invention. FIG. 7B is similar to FIG. 7A. The difference between the two embodiments is that in the metal layer 120 of FIG. 7B, the length of the first portion 131-1 of the first slot 131 is greater than the length of the second portion 131-2 of the first slot 131. In other embodiments, the length of the first portion 131-1 of the first slot 131 may be smaller than the length of the second portion 131-2 of the first slot 131.

FIG. 7C is a diagram illustrating the metal layer 120 according to an embodiment of the invention. As shown in FIG. 7C, the first slot 131 of the metal layer 120 completely separates the upper element 121 from the main element 122. In addition, the mobile device further comprises a conductive element 710, which extends across the first slot 131 and couples the upper element 121 to the main element 122. In some embodiments, the conductive element 710 is an FPCB (Flexible Printed Circuit Board), which is mainly configured to electrically couple the upper element 121 to the main element 122. Note that the metal layers of FIGS. 7A-7C may be applied to the mobile devices of FIG. 1 and FIGS. 2A-2F. In the embodiment, the feeding element 190 is disposed away from the conductive element 710.

Figures 8A, 8B, 8C:
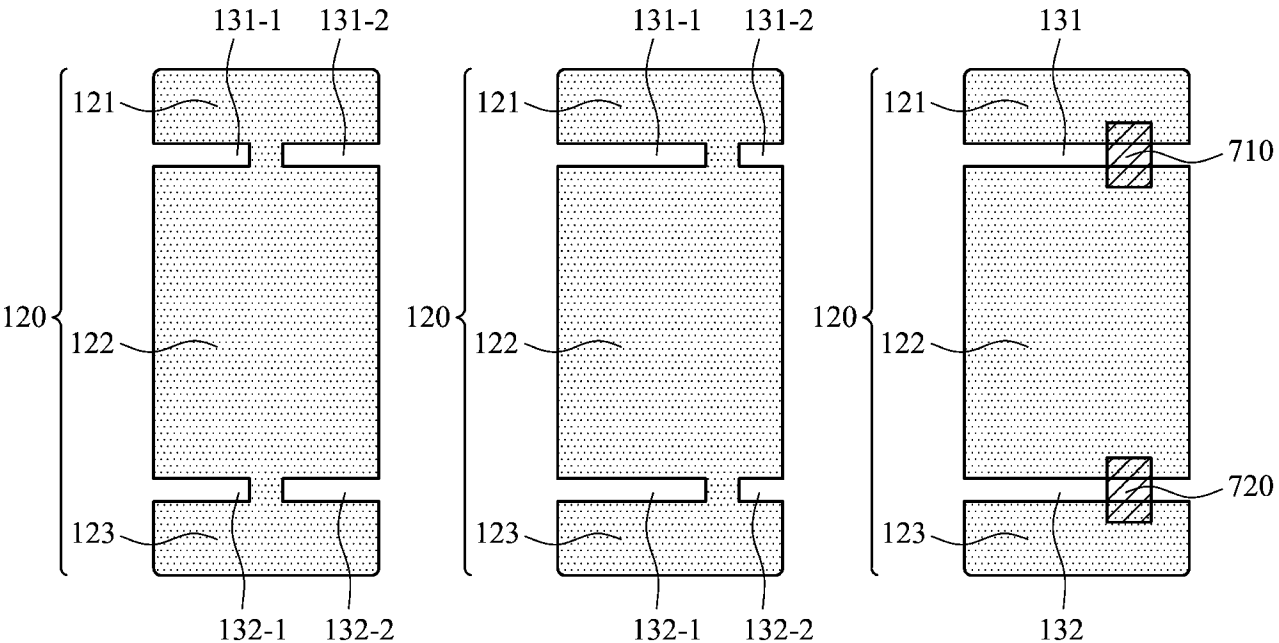
FIGS. 8A-8C are diagrams illustrating metal layers according to some embodiments of the invention.

FIGS. 8A-8C are diagrams illustrating the metal layer 120 according to some embodiments of the invention. As shown in FIGS. 8A-8C, the metal layer 120 further comprises the lower element 123, and the second slot 132 with a different shape is formed between the main element 122 and the lower element 123. Note that the metal layers of FIGS. 8A-8C may be applied to the mobile devices of FIG. 3, FIGS. 4A-4F, FIGS. 5A-5F, and FIGS. 6A-6F.

Figure 9:
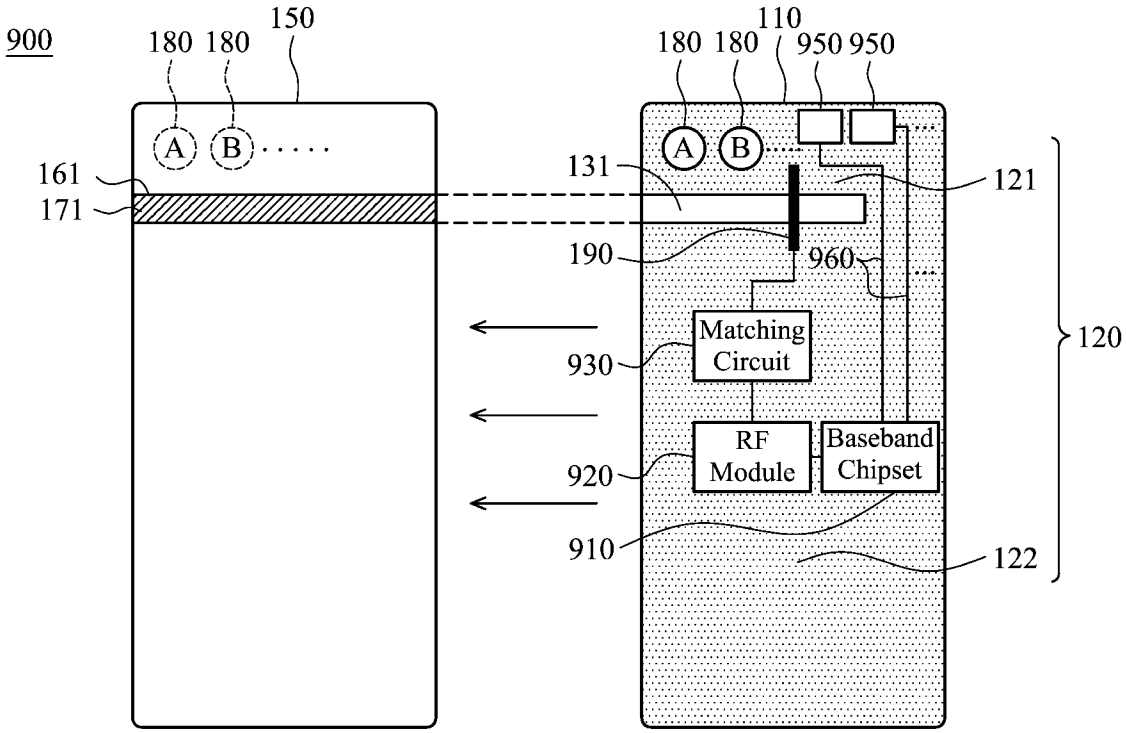
FIG. 9 is a diagram illustrating a mobile device according to a preferred embodiment of the invention.

FIG. 9 is a diagram illustrating a mobile device 900 according to a preferred embodiment of the invention. The mobile device 900 is similar to the mobile device 100 of FIG. 1. The differences between the two embodiments are as follows. The mobile device 900 further comprises a baseband chipset 910, an RF (Radio Frequency) module 920, and a matching circuit 930. In the embodiment, the baseband chipset 910, the RF module 920, and the matching circuit 930 are disposed on the main element 122 of the metal layer 120. In another embodiment, the metal layer 120 further comprises the lower element 123, and the second slot 132 is formed between the main element 122 and the lower element 123 (as shown in FIG. 3 and FIGS. 8A-8C). The baseband chipset 910 may be coupled through the RF module 920 and the matching circuit 930 to the feeding element 190 to excite the antenna structure of the mobile device 900. The baseband chipset 910 is considered to be a signal source of the mobile device 900. In addition, the mobile device 900 further comprises one or more electronic components 950, which may be disposed on the upper element 121 or the lower element 123 of the metal layer 120. The electronic components 950 comprise a speaker, a receiver, a microphone, a camera, a USB (Universal Serial Bus) socket, a memory card socket, a vibrator, and/or an audio jack. The electronic components 950 are coupled through one or more metal traces 960 to the baseband chipset 910, and the metal traces 960 do not cross the first slot 131 of the metal layer 120 to avoid interfering with the antenna structure. Note that the electronic components 950 are disposed on a non-slot region of the antenna structure of the mobile device 900, and are considered to be a portion of the antenna structure. Accordingly, the electronic components 950 do not much affect the radiation performance of the antenna structure. In the embodiment, the antenna structure is integrated with the electronic components 950, and the inner design space of the mobile device 900 is effectively saved.

Figure 10A:
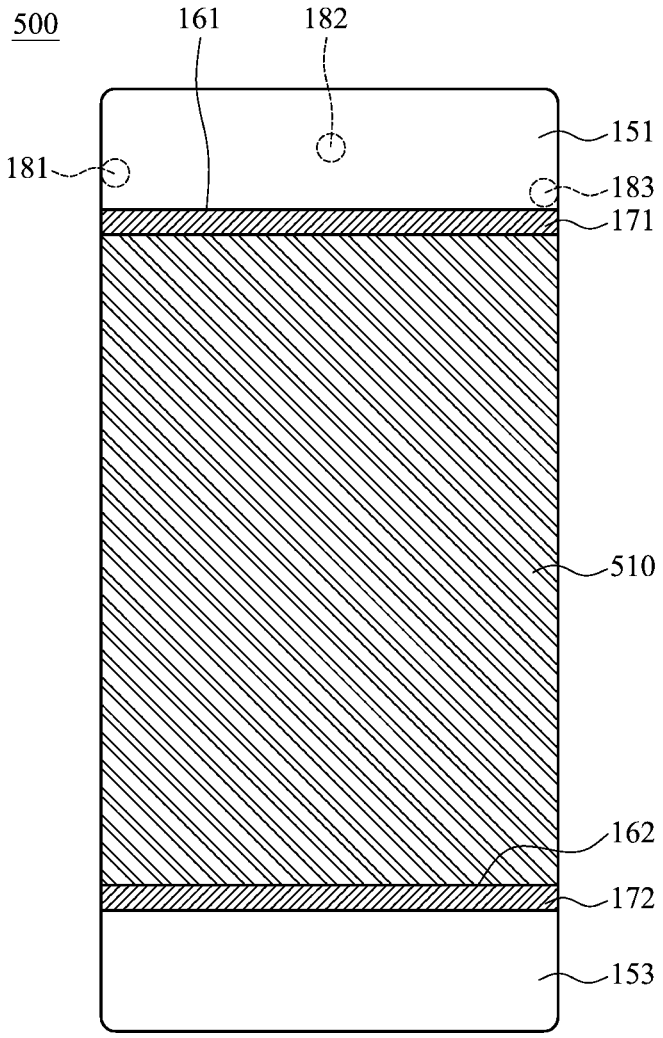
FIGS. 10A-10F are six-sided views of a mobile device according to an embodiment of the invention.
Figure 10B:
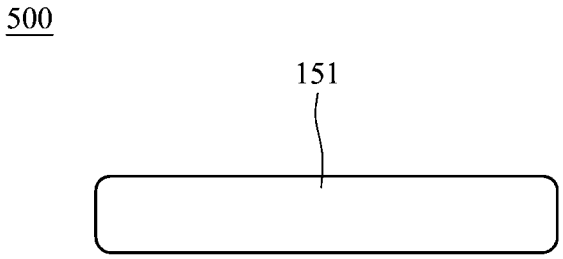
Figure 10C:
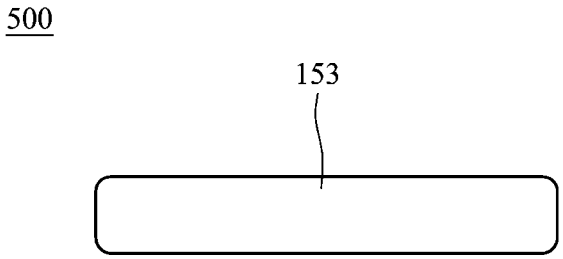
Figure 10D:
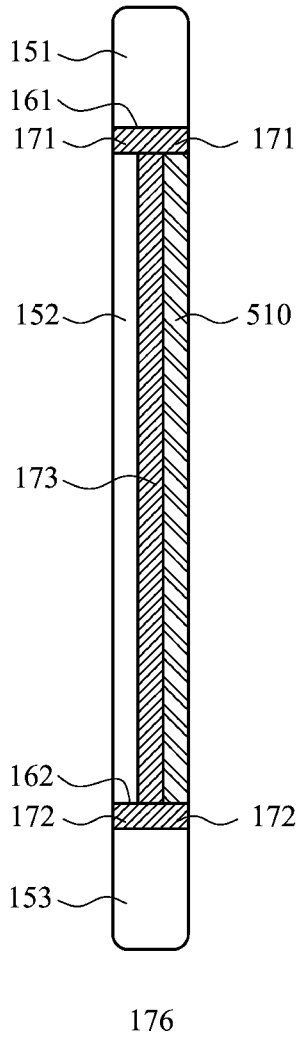
Figure 10E:
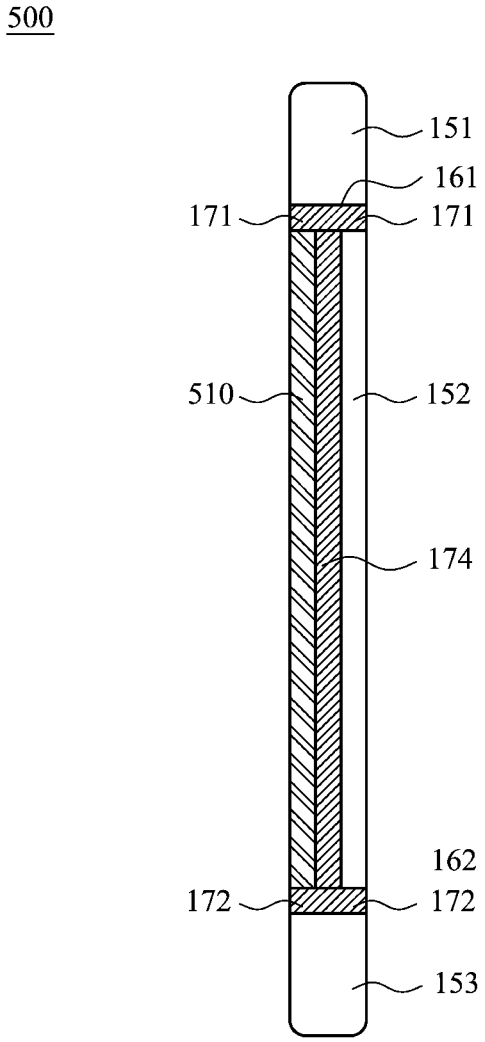
Figure 10F:
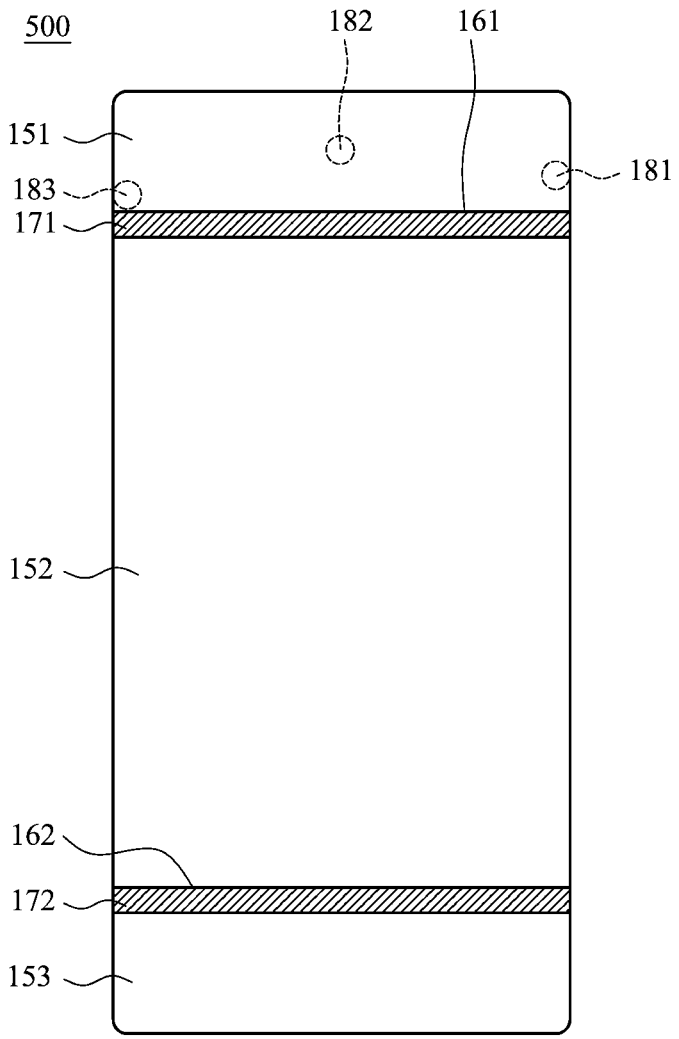
Figure 10G:
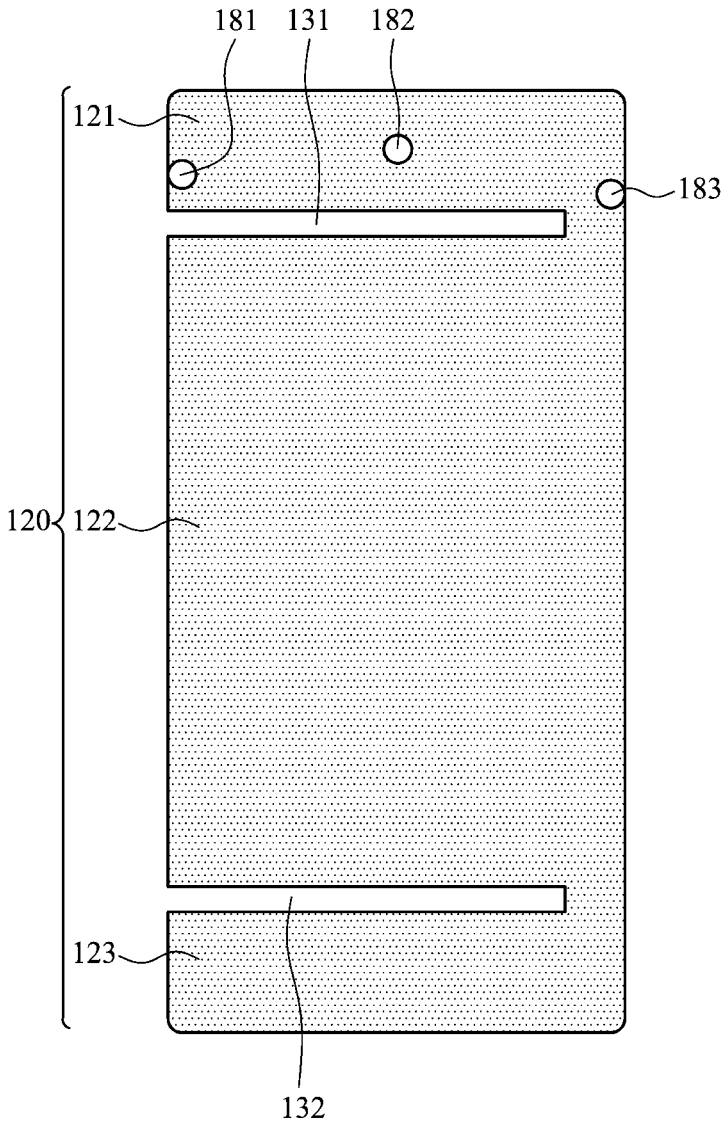
FIG. 10G is a diagram illustrating a metal layer according to an embodiment of the invention.

Refer to FIGS. 10A-10G together. These figures describe the connection between the metal housing and the metal layer in detail. FIGS. 10A-10F are six-sided views of the mobile device 500 according to an embodiment of the invention. FIG. 10G is a diagram illustrating the metal layer 120 according to an embodiment of the invention (similar to FIG. 3). In the embodiment, a plurality of connection elements 181, 182, and 183 couple the upper element 121 of the metal layer 120 to the upper cover 151 of the metal housing 150. By changing the number of connection elements 181, 182, and 183 and positions thereof, the length of the resonant path of the antenna structure of the mobile device 500 can be adjusted, and therefore the operation band of the antenna structure can be controlled. For example, when the feeding element 190 is coupled closer to the open end of the slot 131, if the connection elements 181, 182, and 183 are all configured to couple the upper element 121 of the metal layer 120 to the upper cover 151 of the metal housing 150, the resonant path of the antenna structure can be the shortest. On the other hand, if only the connection element 181 couples to the upper cover 151, the resonant path of the antenna structure can be the longest. A person of ordinary skill in the art can change the number and positions of the connection elements according to different antenna designs (e.g., the feeding position of the feeding element, the direction of the open end of the slot, and the disposition of the conductive element) to tune the desired bands.

Figure 11A:
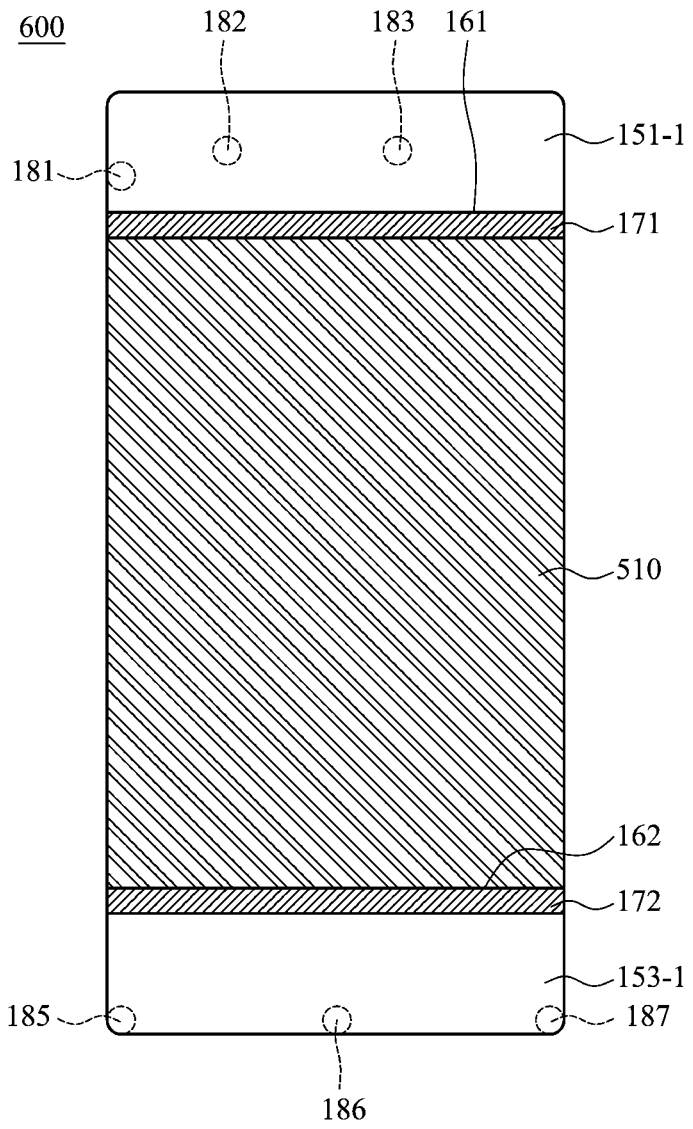
FIGS. 11A-11F are six-sided views of a mobile device according to an embodiment of the invention.
Figure 11B:
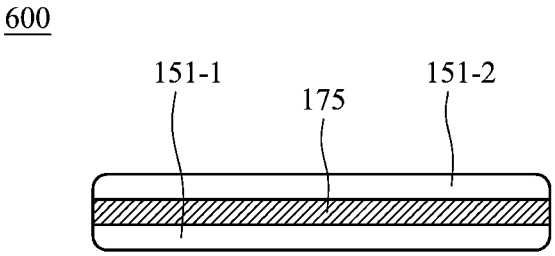
Figure 11C:
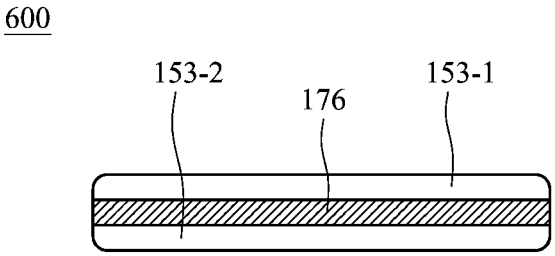
Figure 11D:
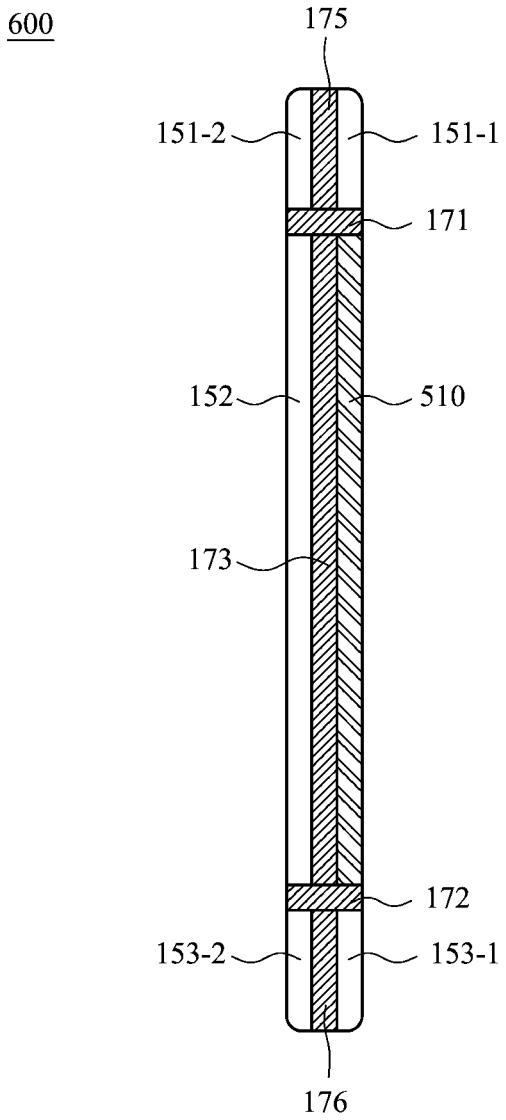
Figure 11E:
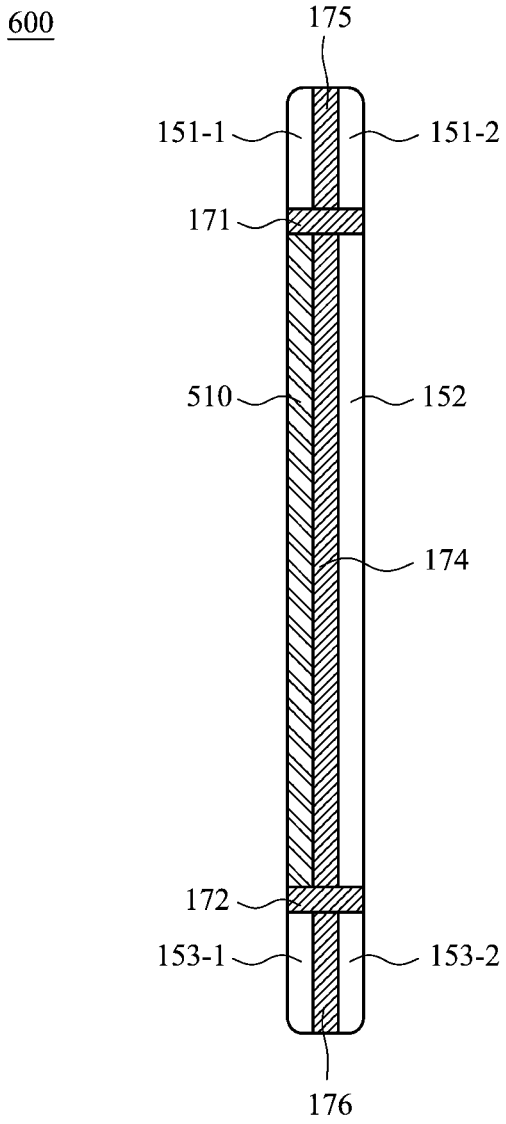
Figure 11F:
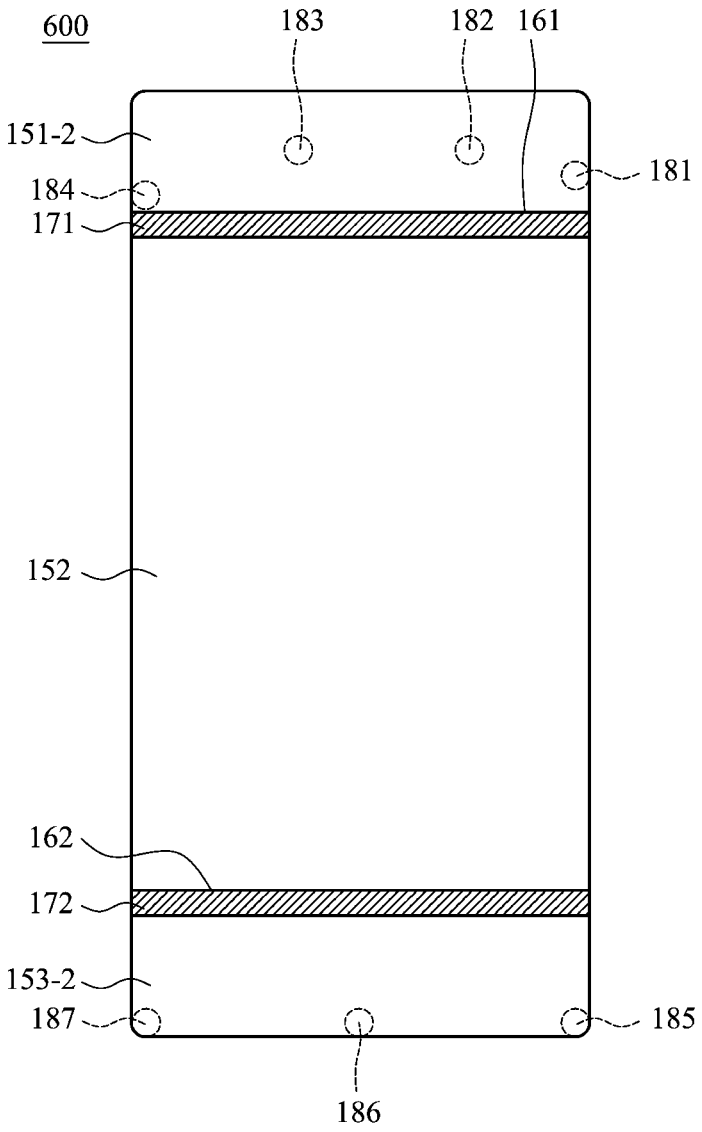
Figure 11G:
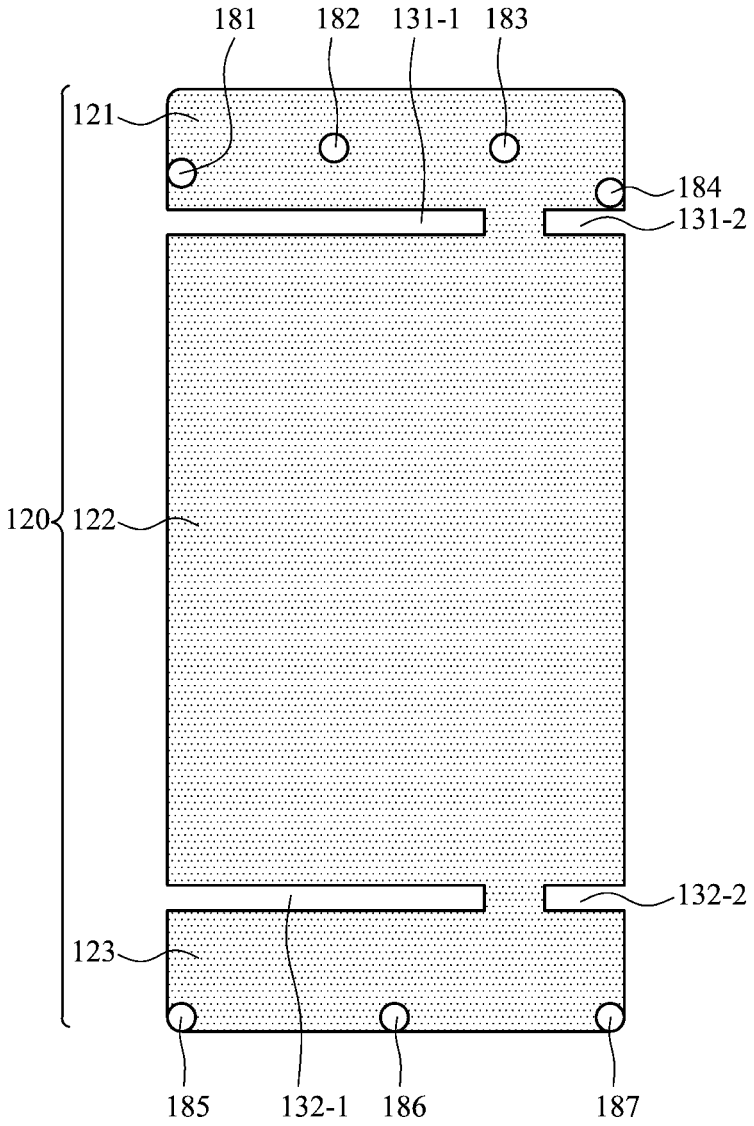
FIG. 11G is a diagram of a metal layer according to an embodiment of the invention.

Refer to FIGS. 11A-11G together. These figures describe the connection between the metal housing and the metal layer in detail. FIGS. 11A-11F are six-sided views of the mobile device 600 according to an embodiment of the invention. FIG. 11G is a diagram illustrating the metal layer 120 according to an embodiment of the invention (similar to FIG. 8B). In the embodiment, a plurality of connection elements 181, 182, and 183 couple the upper element 121 of the metal layer 120 to the first upper sub-cover 151-1 of the metal housing 150, and a plurality of connection elements 181, 182, 183, and 184 couple the upper element 121 of the metal layer 120 to the second upper sub-cover 151-2 of the metal housing 150, and a plurality of connection elements 185, 186, and 187 couple the lower element 123 of the metal layer 120 to the first lower sub-cover 153-1 of the metal housing 150, and a plurality of connection elements 185, 186, and 187 couple the lower element 123 of the metal layer 120 to the second lower sub-cover 153-2 of the metal housing 150. In other embodiments, the adjustments are made where a plurality of connection elements 181, 182, 183, and 184 couple the upper element 121 of the metal layer 120 to the first upper sub-cover 151-1 of the metal housing 150, and a plurality of connection elements 181, 182, and 183 couple the upper element 121 of the metal layer 120 to the second upper sub-cover 151-2 of the metal housing 150. As mentioned above, by changing the number of connection elements 181, 182, 183, 184, 185, 186, and 187 and positions thereof, the length of the resonant path of the antenna structure of the mobile device 600 can be adjusted. A main resonant path may be formed by the upper element 121 of the metal layer 120 and the first upper sub-cover 151-1 or the second upper sub-cover 151-2 of the metal housing 150. Another resonant path may be formed by the lower element 123 of the metal layer 120 and the first lower sub-cover 153-1 or the second lower sub-cover 153-2 of the metal housing 150. The resonant path does not include the middle cover 152. The operation bands of the antenna structure are accordingly controlled.

Figure 12A:
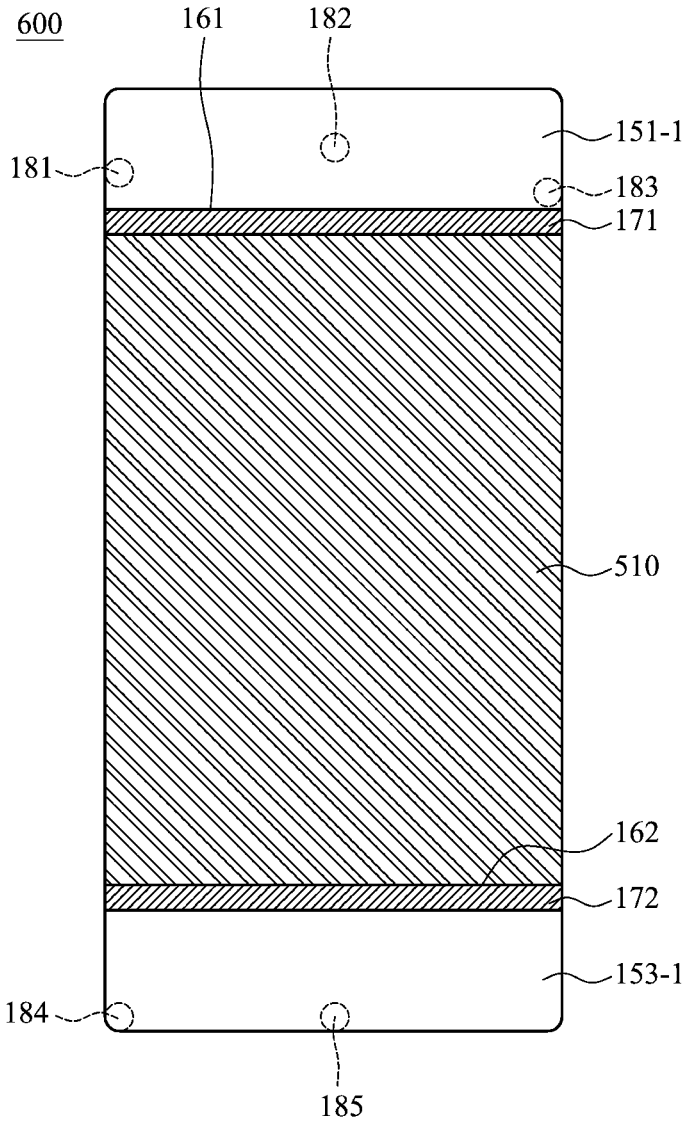
FIGS. 12A-12F are six-sided views of a mobile device according to an embodiment of the invention.
Figure 12B:
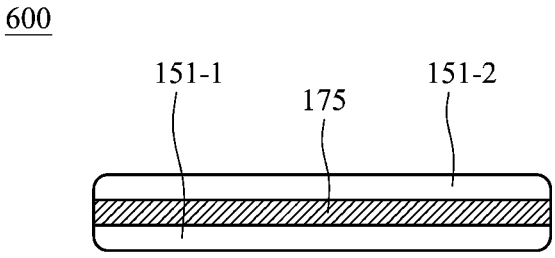
Figure 12C:
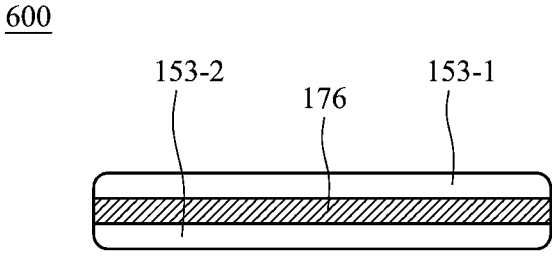
Figure 12D:
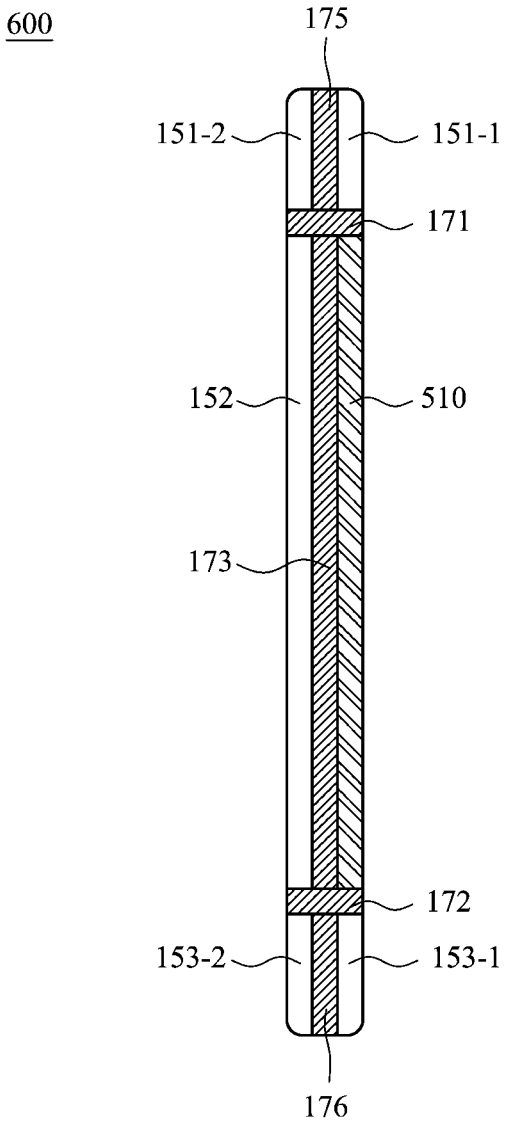
Figure 12E:
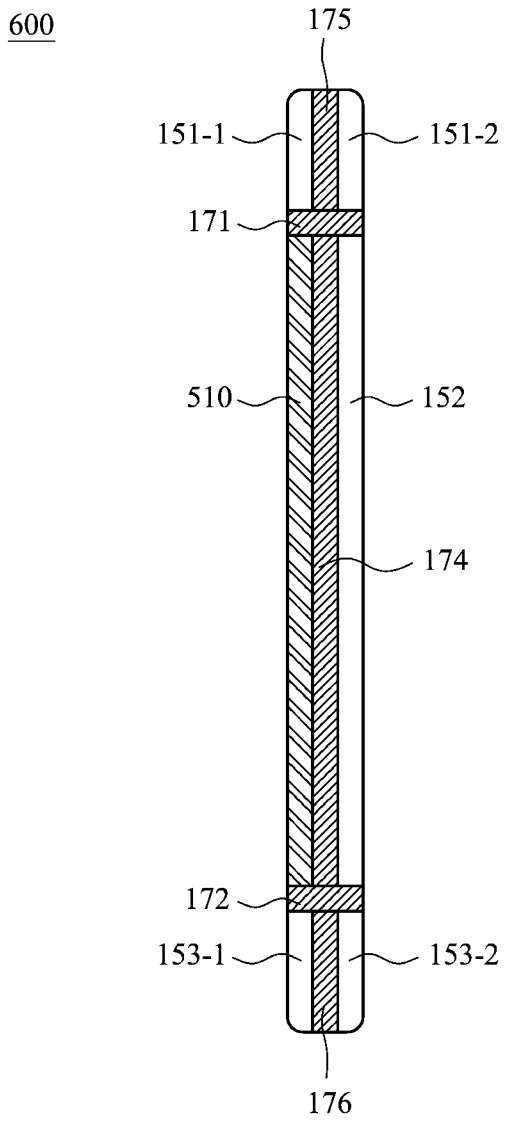
Figure 12F:
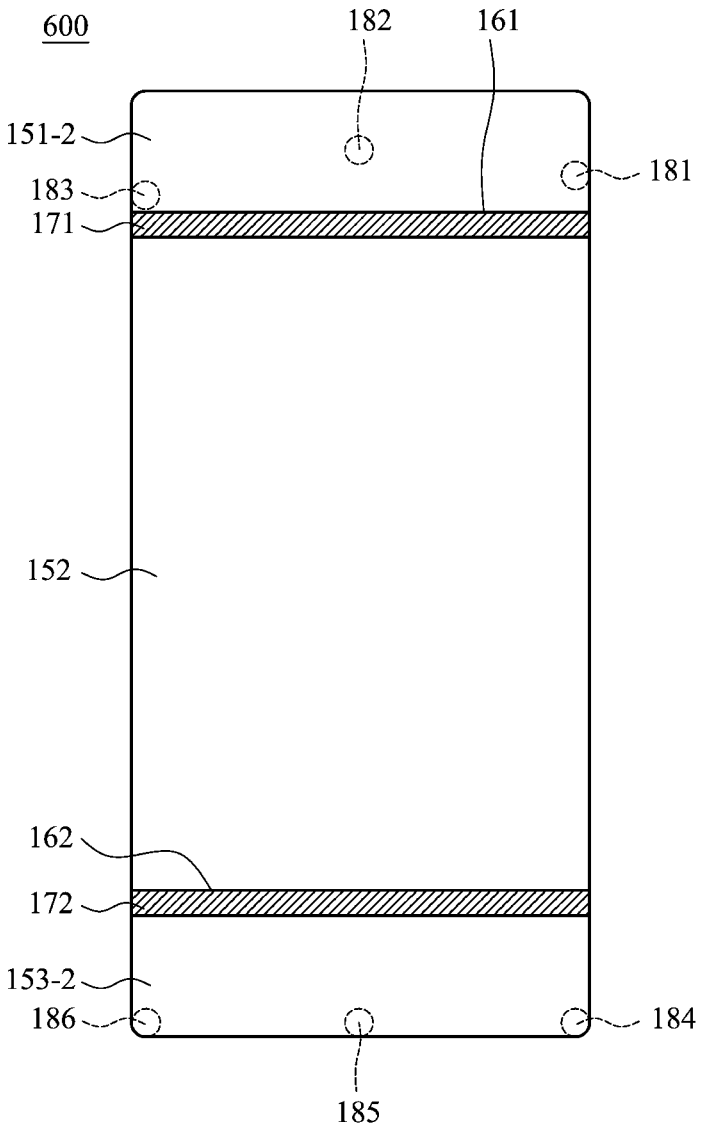
Figure 12G:
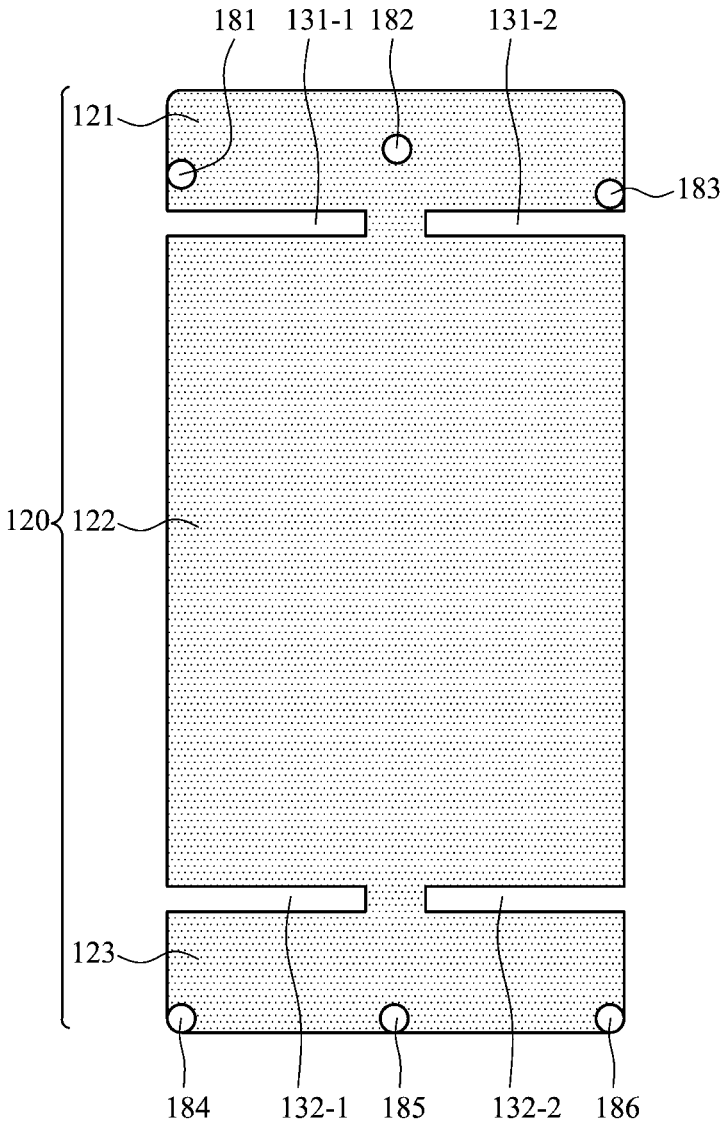
FIG. 12G is a diagram illustrating a metal layer according to an embodiment of the invention.

Refer to FIGS. 12A-12G together. These figures describe the connection between the metal housing and the metal layer in detail. FIGS. 12A-12F are six-sided views of the mobile device 600 according to an embodiment of the invention. FIG. 12G is a diagram illustrating the metal layer 120 according to an embodiment of the invention (similar to FIG. 8A). In the embodiment, a plurality of connection elements 181, 182, and 183 couple the upper element 121 of the metal layer 120 to the first upper sub-cover 151-1 of the metal housing 150, and a plurality of connection elements 181, 182, and 183 couple the upper element 121 of the metal layer 120 to the second upper sub-cover 151-2 of the metal housing 150, and a plurality of connection elements 184 and 185 couple the lower element 123 of the metal layer 120 to the first lower sub-cover 153-1 of the metal housing 150, and a plurality of connection elements 184, 185, and 186 couple the lower element 123 of the metal layer 120 to the second lower sub-cover 153-2 of the metal housing 150. In other embodiments, the adjustments are made where a plurality of connection elements 184, 185, and 186 couple the lower element 123 of the metal layer 120 to the first lower sub-cover 153-1 of the metal housing 150, and a plurality of connection elements 184 and 185 couple the lower element 123 of the metal layer 120 to the second lower sub-cover 153-2 of the metal housing 150. As mentioned above, by changing the number of connection elements 181, 182, 183, 184, 185, and 186 and positions thereof, the length of the resonant path of the antenna structure of the mobile device 600 can be adjusted. The resonant path does not include the middle cover 152. The operation bands of the antenna structure are accordingly controlled.

Figure 13A:
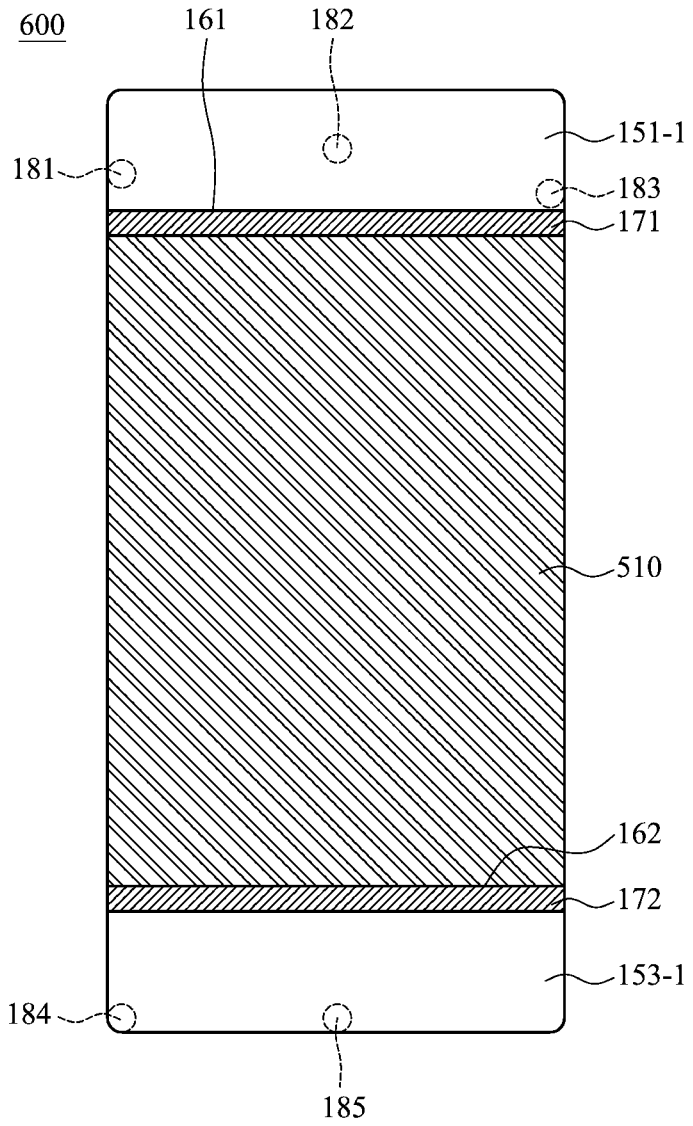
FIGS. 13A-13F are six-sided views of a mobile device according to an embodiment of the invention.
Figure 13B:
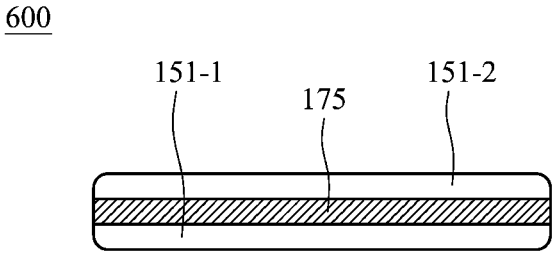
Figure 13C:
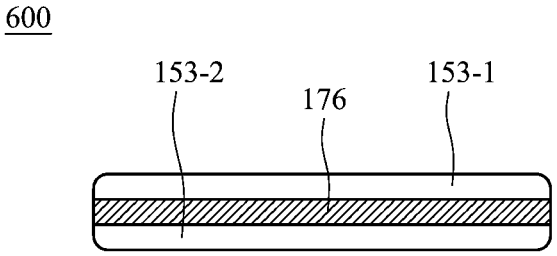
Figure 13D:
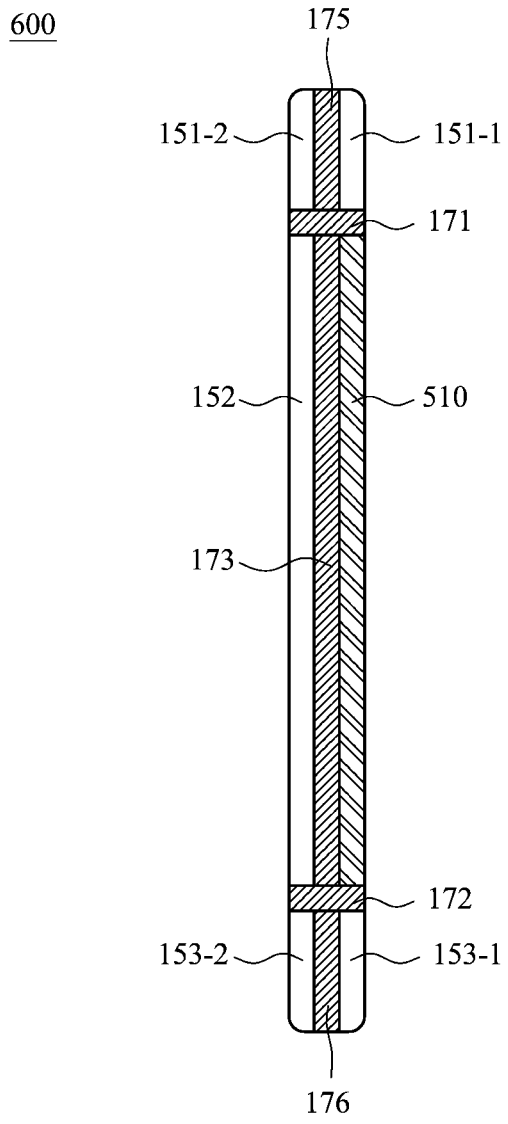
Figure 13E:
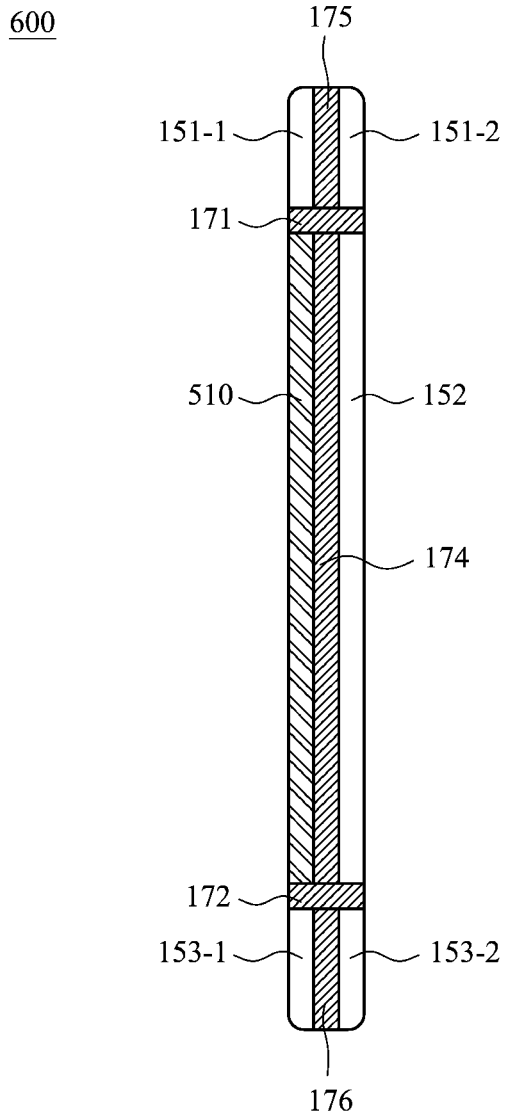
Figure 13F:
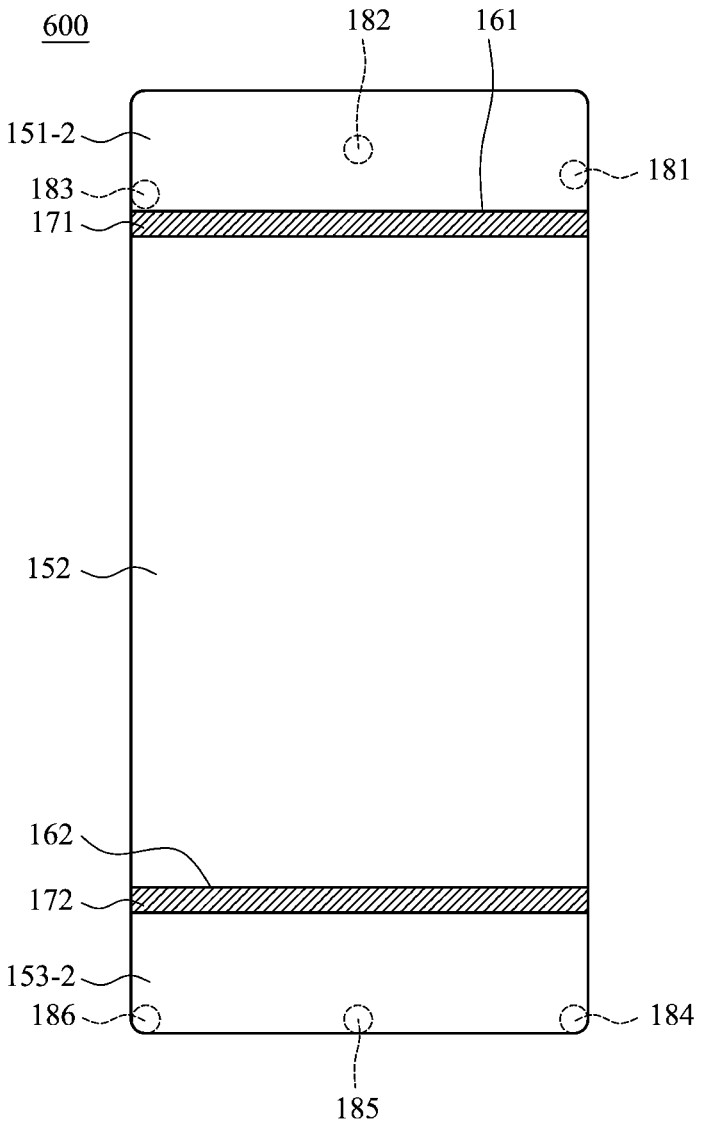
Figure 13G:
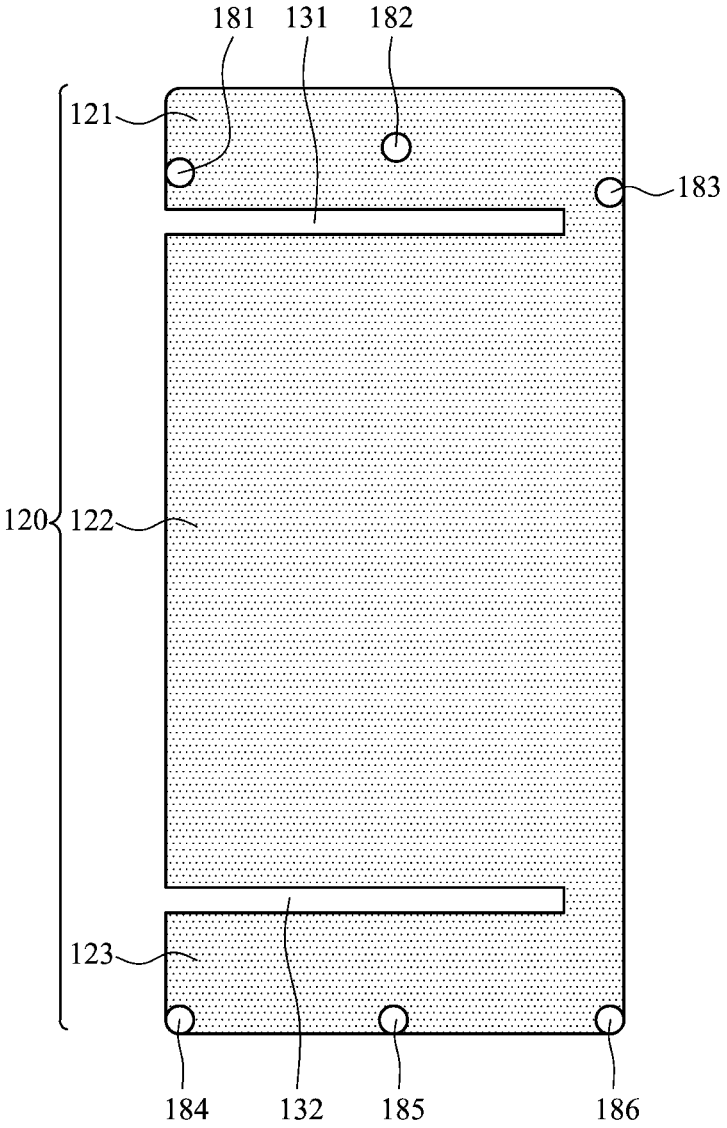
FIG. 13G is a diagram illustrating a metal layer according to an embodiment of the invention.

Refer to FIGS. 13A-13G together. These figures describe the connection between the metal housing and the metal layer in detail. FIGS. 13A-13F are six-sided views of the mobile device 600 according to an embodiment of the invention. FIG. 13G is a diagram illustrating the metal layer 120 according to an embodiment of the invention (similar to FIG. 3). In the embodiment, a plurality of connection elements 181, 182, and 183 couple the upper element 121 of the metal layer 120 to the first upper sub-cover 151-1 of the metal housing 150, and a plurality of connection elements 181, 182, and 183 couple the upper element 121 of the metal layer 120 to the second upper sub-cover 151-2 of the metal housing 150, and a plurality of connection elements 184 and 185 couple the lower element 123 of the metal layer 120 to the first lower sub-cover 153-1 of the metal housing 150, and a plurality of connection elements 184, 185, and 186 couple the lower element 123 of the metal layer 120 to the second lower sub-cover 153-2 of the metal housing 150. In other embodiments, the adjustments are made where a plurality of connection elements 184, 185 and 186 couple the lower element 123 of the metal layer 120 to the first lower sub-cover 153-1 of the metal housing 150, and a plurality of connection elements 184 and 185 couple the lower element 123 of the metal layer 120 to the second lower sub-cover 153-2 of the metal housing 150. As mentioned above, by changing the number of connection elements 181, 182, 183, 184, 185, and 186 and positions thereof, the length of the resonant path of the antenna structure of the mobile device 600 can be adjusted. The resonant path does not include the middle cover 152. The operation bands of the antenna structure are accordingly controlled.

Figure 14A:
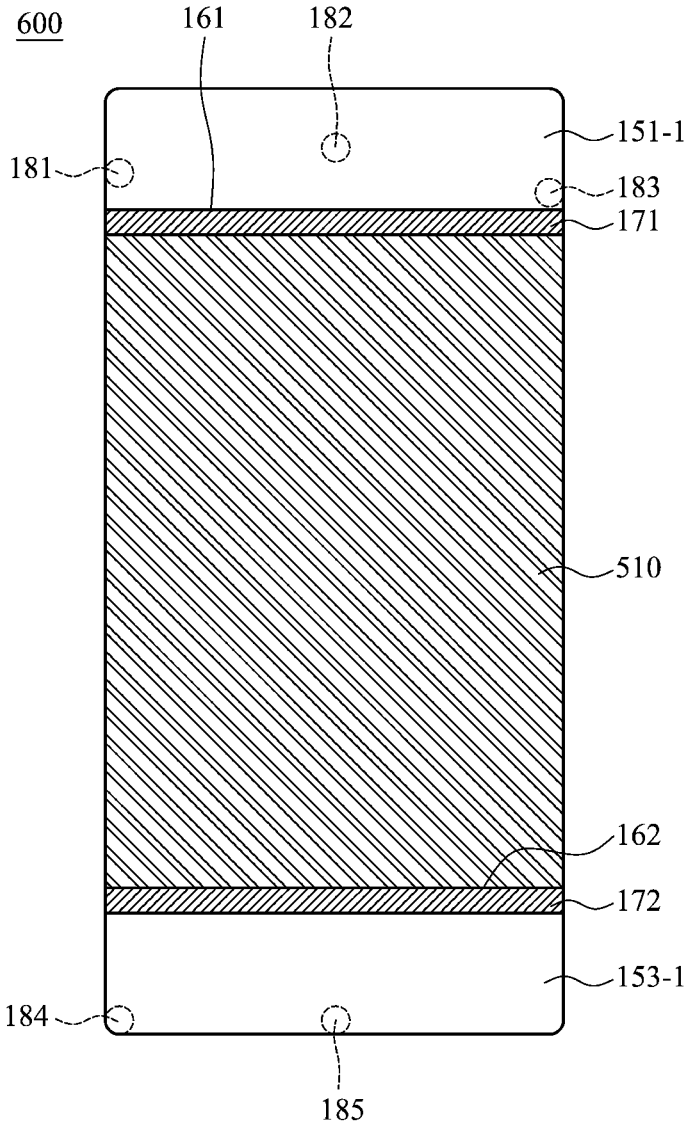
FIGS. 14A-14F are six-sided views of a mobile device according to an embodiment of the invention.
Figure 14B:
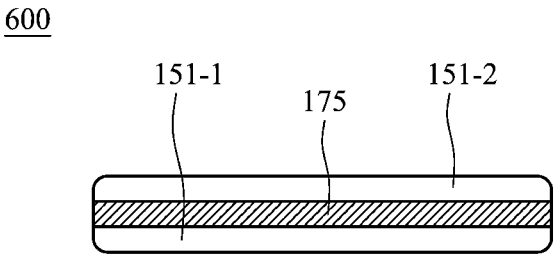
Figure 14C:
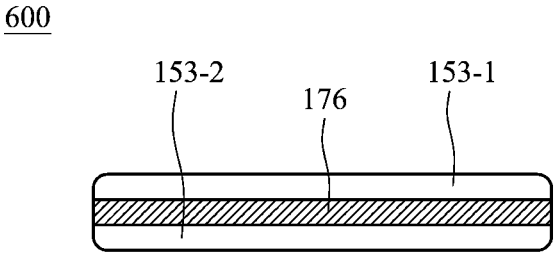
Figure 14D:
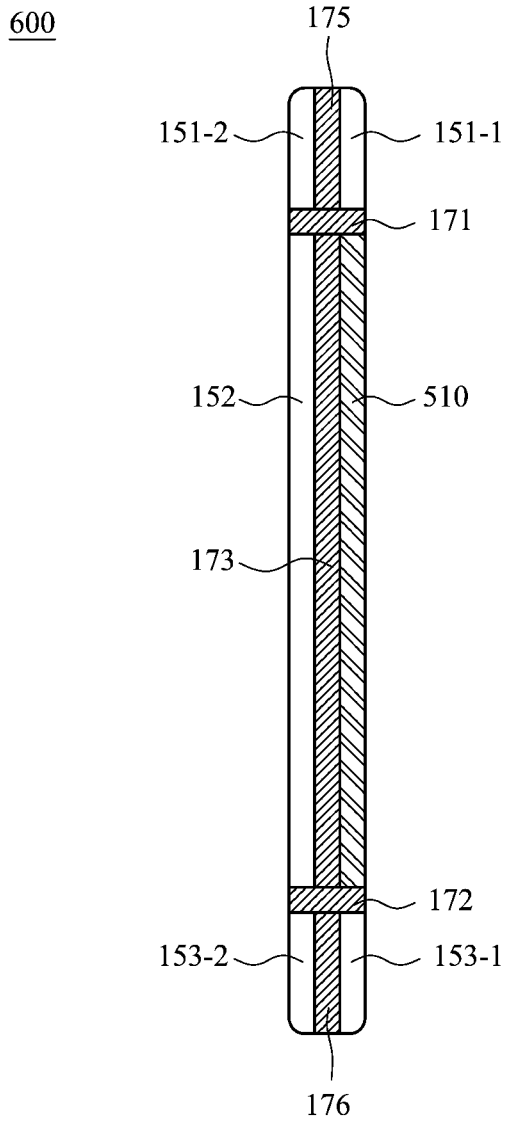
Figure 14E:
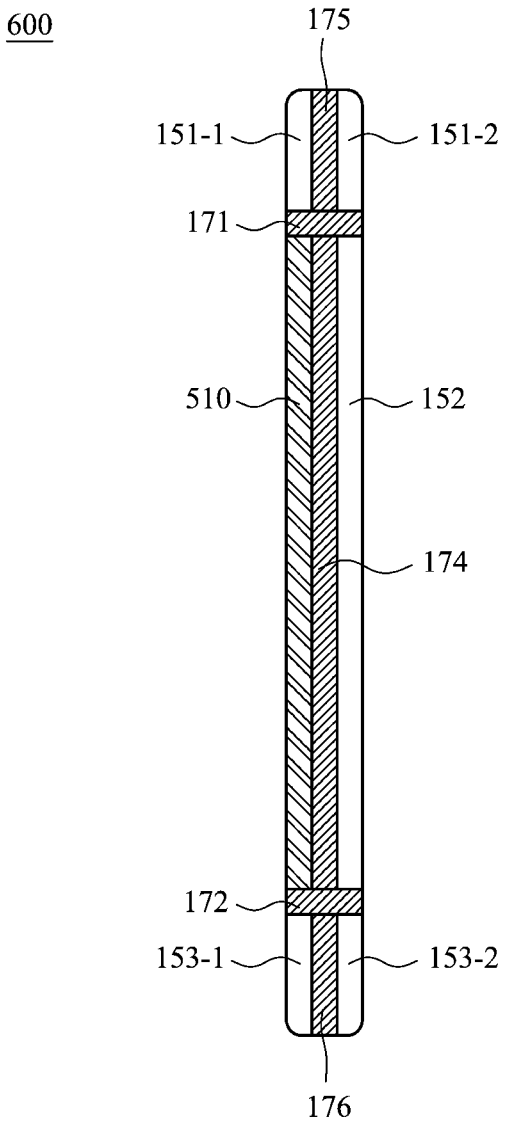
Figure 14F:
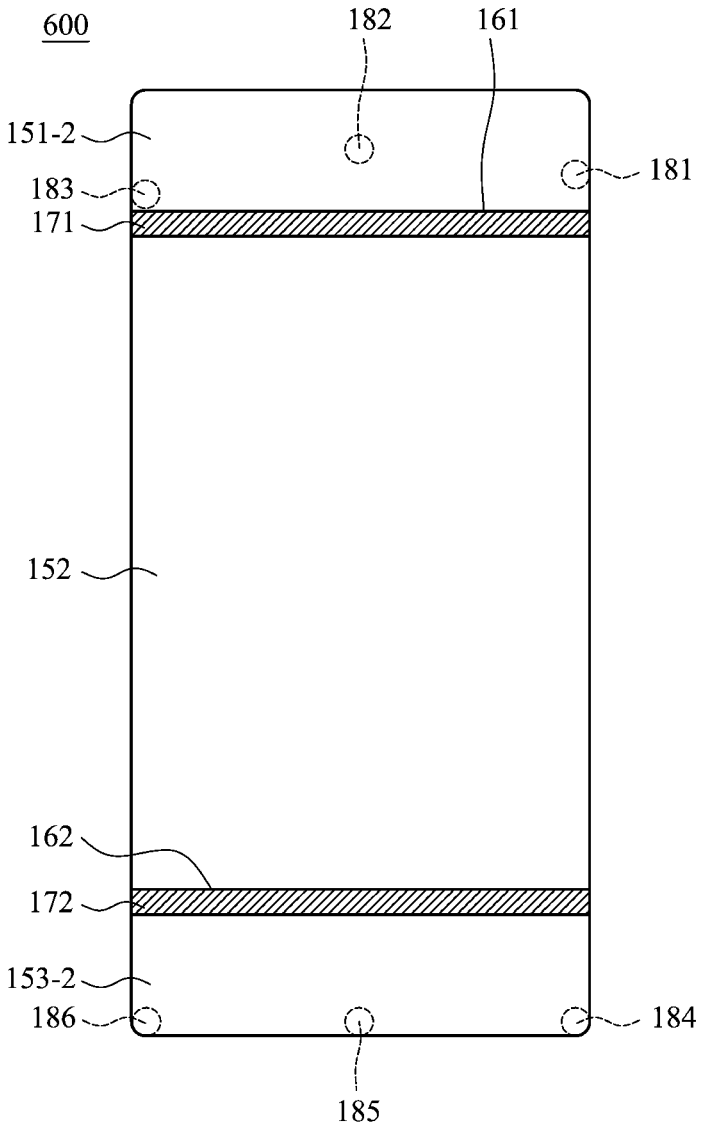
Figure 14G:
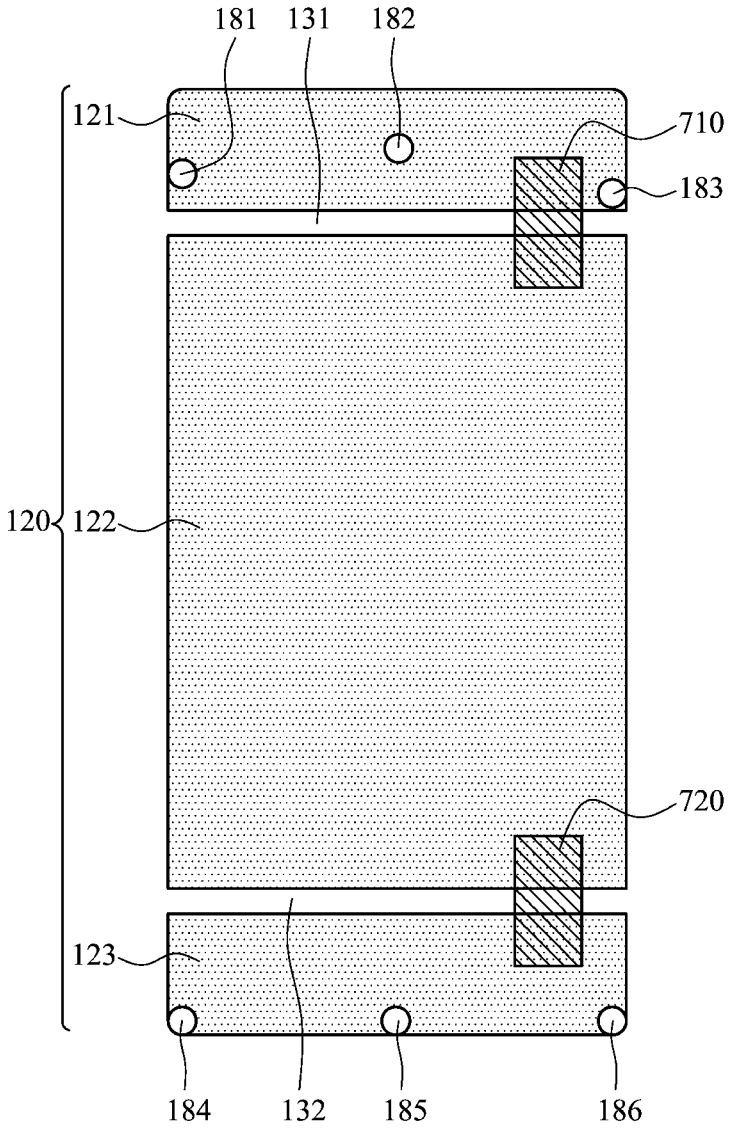
FIG. 14G is a diagram illustrating a metal layer according to an embodiment of the invention.

Refer to FIGS. 14A-14G together. These figures describe the connection between the metal housing and the metal layer in detail. FIGS. 14A-14F are six-sided views of the mobile device 600 according to an embodiment of the invention. FIG. 14G is a diagram illustrating the metal layer 120 according to an embodiment of the invention (similar to FIG. 8C). In the embodiment, a plurality of connection elements 181, 182, and 183 couple the upper element 121 of the metal layer 120 to the first upper sub-cover 151-1 of the metal housing 150, and a plurality of connection elements 181, 182, and 183 couple the upper element 121 of the metal layer 120 to the second upper sub-cover 151-2 of the metal housing 150, and a plurality of connection elements 184 and 185 couple the lower element 123 of the metal layer 120 to the first lower sub-cover 153-1 of the metal housing 150, and a plurality of connection elements 184, 185, and 186 couple the lower element 123 of the metal layer 120 to the second lower sub-cover 153-2 of the metal housing 150. In other embodiments, the adjustments are made where a plurality of connection elements 184, 185 and 186 couple the lower element 123 of the metal layer 120 to the first lower sub-cover 153-1 of the metal housing 150, and a plurality of connection elements 184 and 185 couple the lower element 123 of the metal layer 120 to the second lower sub-cover 153-2 of the metal housing 150. As mentioned above, by changing the number of connection elements 181, 182, 183, 184, 185, and 186 and positions thereof, the length of the resonant path of the antenna structure of the mobile device 600 can be adjusted. The resonant path does not include the middle cover 152. The operation bands of the antenna structure are accordingly controlled.

Figure 15:
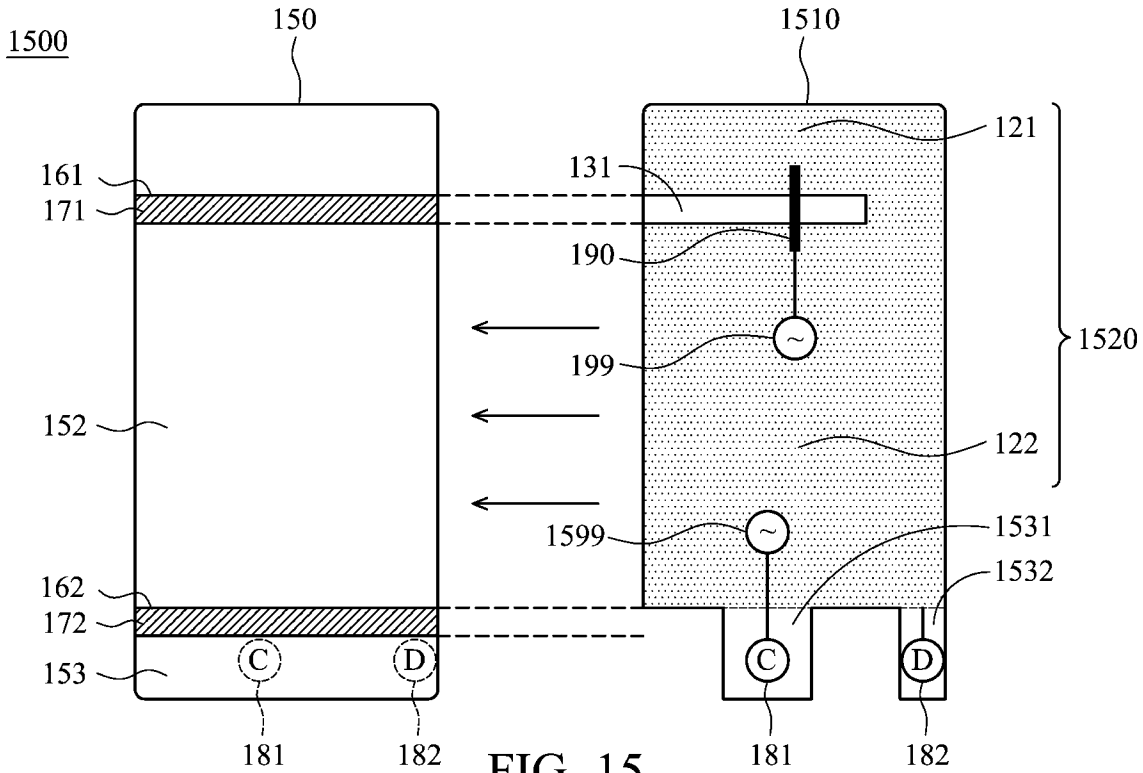
FIG. 15 is a diagram of a mobile device according to an embodiment of the invention.

FIG. 15 is a diagram illustrating a mobile device 1500 according to an embodiment of the invention. The mobile device 1500 is similar to the mobile device 300 of FIG. 3. The differences between the two embodiments are as follows. The mobile device 1500 does not include any lower element 123, that is, a metal layer 1520 merely comprises the upper element 121 and the main element 122. In addition, a dielectric substrate 1510 of the mobile device 1500 is smaller and further comprises two protruded portions 1531 and 1532. The second slit 162 of the metal housing 150 has a perpendicular projection on the dielectric substrate 1510, and the projection partially overlaps the protruded portions 1531 and 1532 of the dielectric substrate 1510. Note that the metal layer 1520 does not lie on the protruded portion 1531 of the dielectric substrate 1510. However, the metal layer 1520 selectively lies or does not lie on the protruded portion 1532 of the dielectric substrate 1510 according to different requirements. In the embodiment, the metal layer 1520 does not lie on the protruded portion 1532, and the connection element 182 thereon may be electrically coupled through a metal trace to the main element 122 to a ground voltage. In other embodiments, if the metal layer 1520 lies on the protruded portion 1532 (not shown), the lying metal layer can be considered a portion of the whole antenna structure, and will not much affect the radiation performance of the antenna structure.

The middle cover 152 of the metal housing 150 is further coupled to the lower cover 153 of the metal housing 150 (not shown). Two connection elements 181 and 182 are disposed on the protruded portions 1531 and 1532 of the dielectric substrate 1510, respectively. Another signal source 1599 is coupled through the connection element 181 to the lower cover 153 of the metal housing 150, and the lower cover 153 of the metal housing 150 is further coupled through the connection element 182 to the main element 122 of the metal layer 1520. A current path is formed accordingly. In the embodiment, another antenna structure is formed by the lower cover 153 of the metal housing 150 and the connection elements 181 and 182, and is used as a main antenna structure or an auxiliary antenna structure. Note that the lower cover 153 of the metal housing 150 is considered to be the radiation element of the antenna structure. In the embodiment, the radiation element of the antenna structure is transferred from the substrate to the metal housing, but the radiation element does not include the middle cover 152. The relative theory and embodiments are similar to those described in FIG. 1, and are not illustrated herein.

Similarly, the mobile device 1500 further comprises the second nonconductive partition 172. The second nonconductive partition 172 is partially disposed in the second slit 162 of the metal housing 150, for example, by being embedded, filled or injected. In the embodiment, the second nonconductive partition 172 may be disposed in the second slit 162 in response to the opening size of the second slit 162. In other embodiments, the configuration area of the second nonconductive partition 172 may be greater than or equal to the opening area of the second slit 162 to meet appearance requirements. In some embodiments, the feeding element 190 and the signal source 199 can be removed from the mobile device 1500.

In other embodiments, the metal housing 150 of the mobile device 1500 can be designed as those in FIGS. 6A-6F. The upper cover 151 of the metal housing 150 of the mobile device 600 comprises a first upper sub-cover 151-1 and a second upper sub-cover 151-2, and the first upper sub-cover 151-1 is partially or completely separated from the second upper sub-cover 151-2. The lower cover 153 of the metal housing 150 of the mobile device 1500 comprises a first lower sub-cover 153-1 and a second lower sub-cover 153-2, and the first lower sub-cover 153-1 is partially or completely separated from the second lower sub-cover 153-2. In the embodiment, the first upper sub-cover 151-1 is completely separated from the second upper sub-cover 151-2, and the first lower sub-cover 153-1 is partially separated from the second lower sub-cover 153-2. Refer to FIG. 6G which is a pictorial view of all the nonconductive partitions of the mobile device 1500 according to an embodiment of the invention. As shown in FIG. 6G, in the mobile device 1500, the first nonconductive partition 171, the second nonconductive partition 172, the third nonconductive partition 173, the fourth nonconductive partition 174, the fifth nonconductive partition 175, and the sixth nonconductive partition 176 are integrally formed (one-piece) and, for example, are made of a plastic material.

Figure 16:
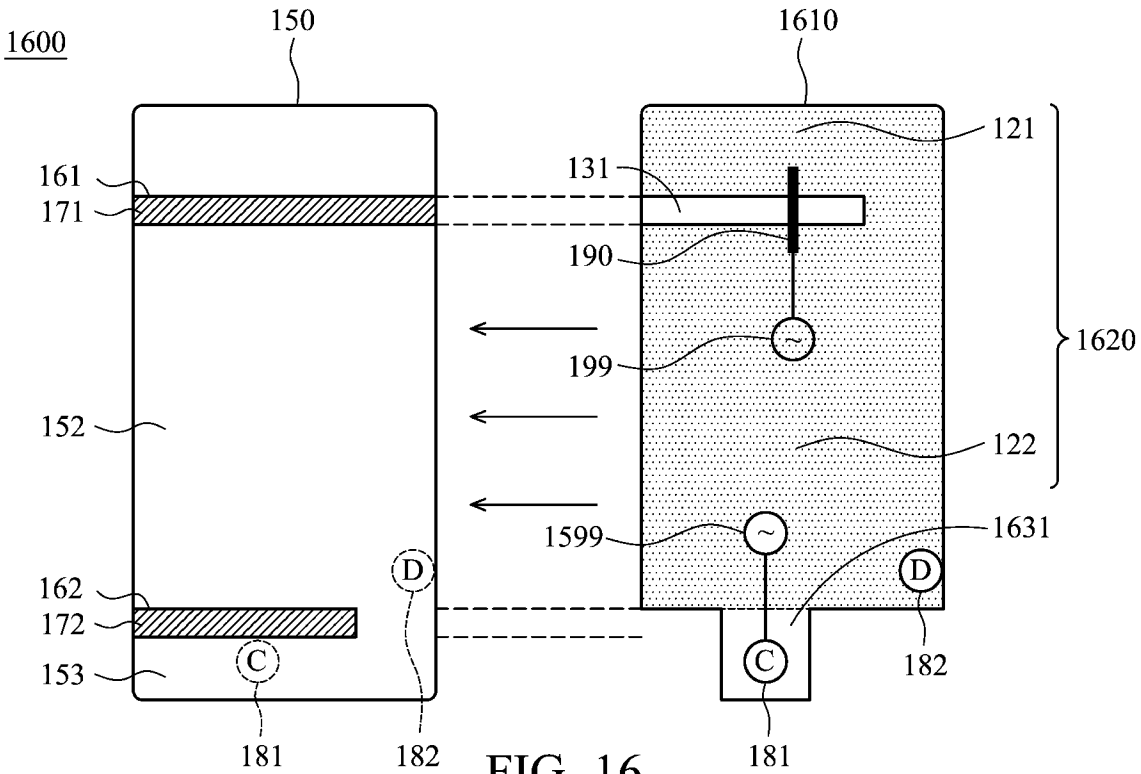
FIG. 16 is a diagram illustrating a mobile device according to another embodiment of the invention.

FIG. 16 is a diagram illustrating a mobile device 1600 according to another embodiment of the invention. The mobile device 1600 is similar to the mobile device 300 of FIG. 3. The differences between the two embodiments are as follows. The mobile device 1600 does not include any lower element 123, that is, a metal layer 1620 merely comprises the upper element 121 and the main element 122. In addition, a dielectric substrate 1610 of the mobile device 1600 is smaller and further comprises a protruded portion 1631. The second slit 162 of the metal housing 150 has a projection on the dielectric substrate 1610, and the projection partially overlaps the protruded portion 1631 of the dielectric substrate 1610. Note that the metal layer 1620 does not lie on the protruded portion 1631 of the dielectric substrate 1610. In the embodiment, the middle cover 152 of the metal housing 150 is merely partially separated from the lower cover 153 of the metal housing 150. A connection element 181 is disposed on the protruded portion 1631 of the dielectric substrate 1610, and another connection element 182 is disposed on the main element 122 of the metal layer 1620. Another signal source 1599 is coupled through the connection element 181 to the lower cover 153 of the metal housing 150, and the lower cover 153 of the metal housing 150 is further coupled through the connection element 182 to the main element 122 of the metal layer 1620. A current path is formed accordingly. In the embodiment, another antenna structure is formed by the lower cover 153 and the middle cover 152 of the metal housing 150 and the connection elements 181 and 182. Similar to the structure of FIG. 15, the lower cover 153 of the metal housing 150 is also considered the radiation element of the antenna structure, but the radiation element does not include the middle cover 152. The difference between the two embodiments is merely the deposition of the connection element 182. The relative theory and embodiments are not illustrated herein.

Similarly, the mobile device 1600 further comprises the second nonconductive partition 172. The second nonconductive partition 172 is partially disposed in the second slit 162 of the metal housing 150, for example, by being embedded, filled or injected. In the embodiment, the second nonconductive partition 172 may be disposed in the second slit 162 in response to the opening size of the second slit 162. In other embodiments, the configuration area of the second nonconductive partition 172 may be greater than or equal to the opening area of the second slit 162 to meet appearance requirements. In some embodiments, the feeding element 190 and the signal source 199 can be removed from the mobile device 1600.

In comparison to other embodiments, the embodiments of FIGS. 15 and 16 remove the lower element 123. Accordingly, the available inner space of the mobile device is increased, and the cost of manufacturing the mobile device is decreased. The space occupied by the lower element 123 is further used to allocate other electronic components 950. Note that all of the designs for nonconductive partitions and metal housings (not shown) of FIGS. 6A-6G, 11A-11F, 12A-12F, and 13A-13F may be applied to the mobile devices of FIGS. 15 and 16.

The embodiments of the disclosure are considered as exemplary only, not limitations. It will be apparent to those skilled in the art that various modifications and variations can be made to the invention, with the true scope of the disclosed embodiments being indicated by the following claims and their equivalents.

What is claimed is:

1. A mobile device, at least comprising:

a metal housing, being substantially a hollow structure, wherein the metal housing has a back region and at least one side region;

a first slit, formed on the metal housing;

a dielectric substrate, disposed in the metal housing; and one or more connection elements, positioned between the metal housing and the dielectric substrate, and electrically coupled to the metal housing, wherein at least one portion of the metal housing is configured to receive and transmit at least one wireless signal, wherein the mobile device further comprises:

a metal layer, at least partially disposed on the dielectric substrate; and a first region which is defined by the metal layer and is formed by a portion of the dielectric substrate, wherein the metal layer substantially does not dispose on the first region, and wherein a vertical projection of the first slit at least partially overlaps the first region of the dielectric substrate.

2. The mobile device as claimed in claim 1, further comprising:

a first nonconductive partition, at least partially disposed in the first slit of the metal housing.

3. The mobile device as claimed in claim 2, wherein the first nonconductive partition is substantially a ring structure.

4. The mobile device as claimed in claim 1, further comprising:

a first feeding element, disposed on the metal layer, and electrically coupled to the connection elements.

5. The mobile device as claimed in claim 4, further comprising:

a first signal source;

a first RF (Radio Frequency) module; and a first matching circuit, wherein the first signal source, the first RF module, and the first matching circuit are disposed on the metal layer, and wherein the first signal source is electrically coupled through the connection elements to the metal housing.

6. The mobile device as claimed in claim 5, wherein the first signal source is electrically coupled to the first RF module and the first matching circuit.

7. The mobile device as claimed in claim 5, further comprising:

a second signal source; and a second feeding element, wherein the second signal source and the second feeding element are disposed on the metal layer, and wherein the second signal source is electrically coupled through the second feeding element and the connection elements to the metal housing.

8. The mobile device as claimed in claim 4, further comprising:

an impedance adjustment element, electrically coupled to the connection elements and the metal housing, wherein the mobile device receives and transmits wireless signals by tuning an impedance value of the impedance adjustment element.

9. The mobile device as claimed in claim 8, wherein the impedance adjustment element is a capacitance adjustment element.

10. The mobile device as claimed in claim 8, wherein the connection elements are metal springs.

11. The mobile device as claimed in claim 1, wherein the first slit is positioned at the back region and the at least one side region.

12. The mobile device as claimed in claim 1, further comprising:

a second slit, wherein the second slit is positioned at the back region and the at least one side region.

13. The mobile device as claimed in claim 12, further comprising:

a second nonconductive partition, at least partially disposed in the second slit of the metal housing.

14. The mobile device as claimed in claim 1, wherein the connection elements electrically couple the metal layer to the metal housing.

15. The mobile device as claimed in claim 1, further comprising:

one or more electronic components, located on the dielectric substrate.

16. A mobile device, at least comprising:

a metal housing, being substantially a hollow structure, wherein the metal housing has a back region and at least one side region;

a first slit, formed on the metal housing;

a dielectric substrate, comprising at least a first protruded portion;

a first connection element, disposed on the first protruded portion, and electrically coupled to the metal housing, wherein the first connection element is positioned inside the metal housing; and a first signal source, disposed on the dielectric substrate, and electrically coupled to the metal housing;

wherein at least one portion of the metal housing is configured to receive and transmit at least one wireless signal.

17. The mobile device as claimed in claim 16, further comprising:

a first nonconductive partition, at least partially disposed in the first slit of the metal housing.

18. The mobile device as claimed in claim 17, wherein the first nonconductive partition is substantially a ring structure.

19. The mobile device as claimed in claim 18, further comprising:

a first feeding element, disposed on the dielectric substrate, and electrically coupled to the first connection element.

20. The mobile device as claimed in claim 19, further comprising:

an impedance adjustment element, electrically coupled to the first connection element and the metal housing, wherein the mobile device receives and transmits wireless signals by tuning an impedance value of the impedance adjustment element.

21. The mobile device as claimed in claim 20, wherein the impedance adjustment element is a capacitance adjustment element.

22. The mobile device as claimed in claim 19, wherein the first feeding element is electrically coupled through a metal spring to the metal housing.

23. The mobile device as claimed in claim 22, wherein an end of the first feeding element is electrically coupled to the metal spring, and another end of the first feeding element is electrically coupled to the first signal source.

24. The mobile device as claimed in claim 17, wherein an area of the first nonconductive partition is not greater than an opening area of the first slit of the metal housing.

25. The mobile device as claimed in claim 16, wherein the first slit is positioned at the back region and the at least one side region.

26. The mobile device as claimed in claim 16, further comprising:

a second slit, wherein the second slit is positioned at the back region and the at least one side region.

27. The mobile device as claimed in claim 26, further comprising:

a second nonconductive partition, at least partially disposed in the second slit of the metal housing.

28. The mobile device as claimed in claim 27, wherein an area of the second nonconductive partition is not greater than an opening area of the second slit of the metal housing.

29. The mobile device as claimed in claim 16, further comprising:

a metal layer, at least partially lying on the dielectric substrate.

30. The mobile device as claimed in claim 29, wherein the first connection element electrically couples the metal layer to the metal housing.

31. The mobile device as claimed in claim 30, further comprising:

a second connection element, disposed on the dielectric substrate;

wherein the first signal source is electrically coupled through the first connection element to the metal housing, and is further electrically coupled through the second connection element to the metal layer.

32. The mobile device as claimed in claim 30, wherein the dielectric substrate further comprises a second protruded portion, a second connection element is disposed on the second protruded portion, and the second connection element is electrically coupled to the metal housing.

33. The mobile device as claimed in claim 32, wherein the first signal source is electrically coupled through the first connection element to the metal housing, and is further electrically coupled through the second connection element to the metal layer.

34. The mobile device as claimed in claim 32, wherein the metal layer does not lie on the second protruded portion of the dielectric substrate.

35. The mobile device as claimed in claim 29, further comprising a first region which is defined by the metal layer and is formed by a portion of the dielectric substrate, and the metal layer does not lie on the first region.

36. The mobile device as claimed in claim 35, wherein a vertical projection of the first slit at least partially overlaps the first region of the dielectric substrate.

37. The mobile device as claimed in claim 29, wherein the metal layer does not lie on the first protruded portion of the dielectric substrate.

38. The mobile device as claimed in claim 16, further comprising:

a first RF (Radio Frequency) module; and a first matching circuit, wherein the first RF module and the first matching circuit are disposed on the dielectric substrate, and wherein the first signal source is electrically coupled to the first RF module and the first matching circuit.

39. The mobile device as claimed in claim 16, further comprising:

a second signal source;

a second feeding element;

a second connection element; and a second protruded portion, extending from the dielectric substrate, wherein the second signal source and the second feeding element are disposed on the dielectric substrate, and wherein the second connection element is disposed on the second protruded portion;

wherein the second signal source is electrically coupled through the second feeding element and the second connection element to the metal housing.

40. The mobile device as claimed in claim 16, further comprising:

one or more electronic components, disposed on the dielectric substrate.

41. The mobile device as claimed in claim 16, wherein the first connection element is a metal spring.

* * * * *